US009033189B2

(12) United States Patent
Sato et al.

(10) Patent No.: US 9,033,189 B2
(45) Date of Patent: May 19, 2015

(54) DRIPPING PREVENTION APPARATUS IN SEALER GUN

(75) Inventors: Kazuhiko Sato, Tendo (JP); Kichizo Maeno, Tendo (JP); Hirota Kudo, Tendo (JP); Shoji Matsuyama, Tendo (JP); Junichi Murao, Tendo (JP); Kazuhiro Ishiyama, Tendo (JP); Shouichi Odashima, Miyagi (JP); Toru Sasaki, Miyagi (JP)

(73) Assignees: TOYOTA MOTOR EAST JAPAN, INC., Miyagi (JP); MTEX MATSUMURA CORPORATION, Yamagata (JP)

( * ) Notice: Subject to any disclaimer, the term of this patent is extended or adjusted under 35 U.S.C. 154(b) by 274 days.

(21) Appl. No.: 13/634,452

(22) PCT Filed: Feb. 28, 2011

(86) PCT No.: PCT/JP2011/055160

§ 371 (c)(1),
(2), (4) Date: Apr. 23, 2013

(87) PCT Pub. No.: WO2011/111644

PCT Pub. Date: Sep. 15, 2011

(65) Prior Publication Data

US 2014/0103074 A1 Apr. 17, 2014

(30) Foreign Application Priority Data

Mar. 12, 2010 (JP) ..... 2010-055494

(51) Int. Cl.
*B05C 11/10* (2006.01)
*B05B 7/24* (2006.01)

(Continued)

(52) U.S. Cl.
CPC ..... *B05C 11/1039* (2013.01); *B05B 7/064* (2013.01); *B05B 7/2405* (2013.01); *B05B 15/00* (2013.01); *E04F 21/165* (2013.01); *B05C 7/00* (2013.01); *B05C 17/002* (2013.01)

(58) Field of Classification Search
CPC .... B05C 11/10; B05C 11/1039; B05C 17/00; B05C 17/0053; B05C 17/00576; B05C 17/01; B05C 17/0123; B05C 17/014; B05C 17/0325; B05C 5/00; B05C 5/0225; E04F 21/165
USPC ..... 222/375, 380, 110, 571; 141/90, 91; 239/106, 104, 110, 112, 119
See application file for complete search history.

(56) References Cited

U.S. PATENT DOCUMENTS 1,609,465 A * 12/1926 Day ..... 239/133
1,807,421 A * 5/1931 Mahoney ..... 222/261

(Continued)

*Primary Examiner* — Kevin P Shaver
*Assistant Examiner* — Michael J Melaragno
(74) *Attorney, Agent, or Firm* — Browdy and Neimark, PLLC

(57) ABSTRACT

A sealer gun that discharges a liquid of a coating agent or filler from a nozzle on its tip is securely prevented from producing dripping that arises as a liquid drips from the nozzle tip and remains when the liquid discharge stops. A pump including a cylinder and a freely movable piston fitting therein is assembled onto a discharge cylinder of the sealer gun, an operation rod interlocked with the pump piston and a grip are interlocked via an interlock mechanism to perform pump operation of suction-discharge by movement of the piston caused by pivoting of the grip, and a suction-discharge aperture of the pump is positioned in an internal space of the nozzle, and configured so that when the liquid discharge sops by releasing the grip, a negative or positive pressure is introduced into the nozzle because of the pump operation caused by resilient pivoting of the grip.

12 Claims, 12 Drawing Sheets

(51) Int. Cl.

| | |
|---|---|
| ***B05B 15/00*** | (2006.01) |
| ***E04F 21/165*** | (2006.01) |
| ***B05C 7/00*** | (2006.01) |
| ***B05C 17/00*** | (2006.01) |
| *B05B 7/06* | (2006.01) |

(56) References Cited

U.S. PATENT DOCUMENTS

| | | | | |
|---|---|---|---|---|
| 1,992,426 | A * | 2/1935 | Herbsman et al. | 239/104 |
| 3,263,889 | A * | 8/1966 | Fortune | 228/20.5 |
| 3,884,409 | A * | 5/1975 | Kaufman | 228/20.5 |
| 3,921,249 | A * | 11/1975 | Fortune | 15/341 |
| 4,215,802 | A * | 8/1980 | Ornsteen | 222/146.2 |
| 4,299,336 | A * | 11/1981 | Studer | 222/80 |
| 4,387,002 | A * | 6/1983 | Knecht | 156/578 |
| 4,634,027 | A * | 1/1987 | Kanarvogel | 222/380 |
| D342,654 | S * | 12/1993 | Jens | D8/30 |
| 6,729,507 | B2 * | 5/2004 | Nagahata et al. | 222/504 |
| 7,543,722 | B2 * | 6/2009 | Yates et al. | 222/135 |
| 7,571,749 | B2 * | 8/2009 | Stocchi | 141/91 |
| 7,841,492 | B2 * | 11/2010 | Laible | 222/442 |
| 2004/0226981 | A1 * | 11/2004 | Nagase et al. | 228/51 |
| 2008/0230002 | A1 * | 9/2008 | Hirata et al. | 118/300 |

* cited by examiner

DRIPPING PREVENTION APPARATUS IN SEALER GUN

TECHNICAL FILED

The present invention relates to an improvement in a means that avoids dripping of a liquid material arising on a tip portion of a nozzle when a discharge of the liquid material is stopped, in a sealer gun that discharges a liquid material of a coating agent or a filler from a discharge aperture of a nozzle of a tip of a discharge cylinder.

BACKGROUND ART

A discharge device for a liquid material in a form of a so-called sealer gun, which is used for coating/filling work of coating or filling a liquid material, such as a coating agent or a filler, into or onto a gap or a space of a structure, is configured such that, as shown in FIG. 1, the base side of a discharge cylinder 1 formed in a barrel shape equipped on its tip side with a nozzle 10 configured to discharge a liquid material is connected to a main body a that is shaped into a hollow cylinder; the discharge cylinder 1 is communicated via an internal space of the main body a to an introduction pipe 30 that is connected to the internal space of the main body a; the body a accommodates therein a valve mechanism 2 configured to disconnect and to establish communication between the introduction pipe 30 and the nozzle 10 of the discharge cylinder 1; a holding unit 3 that is shaped in a continuously integrated manner with the body a is formed and provided on the outer circumferential side of the introduction pipe 30 connected to the main body a; a grip member 4 configured capable to be gripped together with the holding unit 3 is arranged on the forward side of the holding unit 3, and the upper side of the member 4 is axially supported by a spindle 40 on the upper side of the body a, so that it is configured to pivot to a position along the holding unit 3 by gripping it together with the holding unit 3, and to pivot to a position separate from the holding unit 3 with a resilient spring (not shown) by releasing a grip; and the grip member 4 is interlocked with the valve mechanism 2 such that the valve mechanism 2 accommodated inside the body a described above can open and close a communication aperture provided between the internal space of the body a and the discharge cylinder 1 through pivoting operation of pivoting by gripping the grip member 4 and resilient pivoting, accordingly, upon operation of gripping the grip member 4, a liquid material is discharged from a tip aperture 10*a* of the nozzle 10 by opening the valve mechanism 2, and upon releasing a grip on the grip member 4, a discharge of a liquid material is stopped.

According to the sealer gun A, when a discharge of a liquid material is stopped by releasing the grip member 4, a dripping phenomenon arises that the liquid material sticks and remains onto the tip portion of the nozzle 10 in a state of hanging like an icicle.

When a discharge of a liquid material is stopped, if the liquid material sticking and remaining as a drip on the tip of the nozzle 10 is left, as it is exposed to outside air, it can be denatured to a liquid material with properties unable to be normally used when performing coating work or filling work next time, therefore, it is treated by wiping out and discarding from the tip of the nozzle 10 immediately after when a discharge is stopped.

The sealer gun has a problem that workability of coating/filling work is inefficient due to the work of wiping out dripping each time when stopping discharge of a liquid material, and a problem that discard of dripping results in a loss of a liquid material.

It is thought that the dripping that a liquid material sticks and remains like hanging from the tip portion of the nozzle when a discharge of a liquid material is stopped cannot be shut off clearly because a liquid material of a coating agent or a filler has viscous properties and high adhesion and cohesiveness; and because a liquid material is pressurized and then sent and supplied into the discharge cylinder, the liquid material inside the discharge cylinder is pushed out with a remaining pressure on the liquid material in the discharge cylinder 1 when discharge is stopped by closing the valve mechanism 2.

As a countermeasure to this, a considerable means can be such that, as shown in FIGS. 2 and 3, a stop valve sv that operates, by operating the grip member 4, to open and to close together with the valve mechanism 2 accommodated in the body a is integrated in a region very close to the tip aperture 10*a* of the nozzle 10 of the tip of the discharge cylinder 1, so that the liquid material remaining in the discharge cylinder 1 under a pressurized condition when a discharge of a liquid material is stopped by releasing the grip member 4 and closing the valve mechanism 2 is made little in quantity only as much as that present in a very short distance between the tip aperture 10*a* of the discharge cylinder 1 and the stop valve sv; and a considerable means can be such that, as shown in FIGS. 4 and 5, a check valve cv that operates to close by pushing a valve body to a seat surface with a spring and to open with a pressure of a liquid material sent into the discharge cylinder 1 by gripping the grip member 4 is provided in a region very close to the tip aperture 10*a* on the tube tip of the nozzle 10 of the discharge cylinder 1, and sandwiching plates 11 configured to be closed as opposed in pair are mounted and provided via an elastic material 12 on an outer region of the tube tip of the nozzle 10, and when the liquid material is discharged from the tip aperture 10*a* of the nozzle 10, opposed portions of the sandwiching plates 11 having been closed together turn opened with a discharge pressure of the liquid material, and when a discharge of the liquid material is stopped, the sandwiching plates 11 are closed together and shut off the liquid material at the front of the tip aperture 10*a* of the nozzle 10.

However, among these means, in the former case, when a discharge of a liquid material is stopped, as depicted by a dot and dash line in FIG. 3, a phenomenon that the liquid material sticks and remains in a dripping state like an icicle hanging from the tip portion of the nozzle 10 still occurs.

It is thought that this is caused by pulling back like hoisting up the liquid material that has been already discharged out from the tip aperture 10*a* of the nozzle 10, with adhesion and cohesiveness originated by viscous properties of the liquid material.

Moreover, also in the latter case, when a discharge of a liquid material is stopped, a phenomenon that a liquid material sticks and remains in a dripping state like an icicle hanging from the tip portion of the nozzle 10 occurs. In the latter case, although a discharged liquid material is shut off by the sandwiching plates 11 at an outer side position of the tube tip of the nozzle 10, a liquid material that has been already discharged via an opposed space between the sandwiching plates, as depicted by a dot and dash line in FIG. 4, becomes sticking on the outer surface of the sandwiching plates 11 and hanging, resultantly, a dripping phenomenon occurs. Furthermore, because an area on the outer surface of the sandwiching plates 11 that is a sticking surface is wider than the circumferential surface of the tube tip of the nozzle 10, more dripping in quantity is produced than that in the former case. These means cannot achieve dripping prevention.

SUMMARY OF THE INVENTION

Problem to be Solved by the Invention

It is aimed to ensure that a sealer gun that discharges a liquid material of a coating agent/a filler from a nozzle on its tip is prevented from producing dripping that arises as a liquid material drips from the tip of the nozzle and remains when a discharge of the liquid material is stopped.

Means for Solving Problem

As a means for solving the problem described above, proposed is a dripping prevention apparatus in a sealer gun characterized in that a base side of a body in a cylindrical shape of which tip side is equipped with a discharge cylinder configured to discharge a liquid material, a holding unit is provided, and a grip member capable to be gripped together with the holding unit is axially supported so as to pivot to a position along the holding unit by gripping and to pivot to a position separate from the holding unit with a resilient spring by releasing a grip, an inside of the body accommodates therein a valve mechanism configured to control disconnection and establishment of communication between an introduction pipe side and a tip side of the discharge cylinder, and operation of opening valve and closing valve of the valve mechanism is interlocked to pivoting motion of the grip member so as to open a valve resulting from pivoting of the grip member by gripping, and to stop a discharge of a liquid material from a tip aperture of a nozzle of a tip of the discharge cylinder by closing the valve resulting from resilient pivoting of the grip member by releasing a grip, wherein a pump that includes a cylinder and a piston fitting in the cylinder in a manner capable to move in and out freely is assembled onto the body, an operation rod interlocked with the piston of the pump and the grip member are interlocked via an interlock mechanism so as to perform pump operation of suction and discharge by moving in and out the piston caused by resilient pivoting of the grip member, and a suction-discharge aperture of the pump is positioned in an internal space of the nozzle on the tip side of the discharge cylinder, and when a discharge of a liquid material is stopped by releasing the grip member, a negative or positive pressure is to be introduced into an inside of the nozzle caused by pump operation resulting from resilient pivoting of the grip member.

Moreover, in addition to this, proposed as a second means is a dripping prevention apparatus in a sealer gun characterized in that on a base side of a body in a cylindrical shape of which tip side is equipped with a discharge cylinder configured to discharge a liquid material, a holding unit is provided, and a grip member capable to be gripped together with the holding unit is axially supported so as to pivot to a position along the holding unit by gripping and to pivot to a position separate from the holding unit with a resilient spring by releasing a grip, an inside of the body accommodates therein a valve mechanism configured to control disconnection and establishment of communication between an introduction pipe side and a tip side of the discharge cylinder, and operation of opening valve and closing valve of the valve mechanism is interlocked to pivoting motion of the grip member so as to open a valve resulting from pivoting of the grip member by gripping, and to close the valve resulting from resilient pivoting of the grip member by releasing a grip, wherein a pump that includes a cylinder and a piston fitting in the cylinder in a manner capable to move in and out freely is assembled onto the body, the pump is interlocked to the grip member via an interlock mechanism so as to perform discharge operation by pushing the piston caused by pivoting when gripping the grip member, and to perform suction operation by pulling the piston caused by resilient pivoting of the grip member when releasing a grip on the grip member, and a suction-discharge aperture of the pump is positioned in an internal space of the nozzle on the tip side of the discharge cylinder, and when a discharge of a liquid material from a tip aperture of the nozzle is stopped by releasing a grip on the grip member, a negative pressure is to be introduced into the nozzle caused by suction operation by the pump resulting from resilient pivoting of the grip member;

moreover, in addition to this, proposed as a third means is a dripping prevention apparatus in a sealer gun characterized in that on a base side of a body in a cylindrical shape of which tip side is equipped with a discharge cylinder configured to discharge a liquid material, a holding unit is provided, and a grip member capable to be gripped together with the holding unit is axially supported so as to pivot to a position along the holding unit by gripping and to pivot to a position separate from the holding unit with a resilient spring by releasing a grip, an inside of the body accommodates therein a valve mechanism configured to control disconnection and establishment of communication between an introduction pipe side and a tip side of the discharge cylinder, and operation of opening valve and closing valve of the valve mechanism is interlocked to pivoting motion of the grip member so as to open a valve resulting from pivoting of the grip member by gripping, and to close the valve resulting from resilient pivoting of the grip member by releasing a grip, wherein a pump that includes a cylinder and a piston fitting in the cylinder in a manner capable to move in and out freely is assembled onto the body, the pump is interlocked to the grip member via an interlock mechanism so as to perform suction operation by pulling the piston caused by pivoting when gripping the grim member, and to perform discharge operation by pushing the piston caused by resilient pivoting of the grip member when releasing a grip on the grip member, and a suction-discharge aperture of the pump is positioned in an internal space of the nozzle on the tip side of the discharge cylinder, and when a discharge of a liquid material is stopped by releasing a grip on the grip member, a positive pressure is to be introduced into the nozzle caused by discharge operation by the pump resulting from resilient pivoting of the grip member;

moreover, in addition to this, proposed as a fourth means is a dripping prevention apparatus in a sealer gun, wherein the pump according to the third means that includes the cylinder provided on the body and the piston fitting in the cylinder in a manner capable to move in and out freely is supported and assembled onto the body by arranging an axial line in parallel to the discharge cylinder on an underside of an outer circumference of the body, the piston of the pump is interlocked to the grip member via an interlock mechanism arranged on an underside of the discharge cylinder, and the suction-discharge aperture of the pump is positioned in the internal space of the nozzle on the tip side of the discharge cylinder;

moreover, in addition to this, proposed as a fifth means is a dripping prevention apparatus in a sealer gun, wherein the pump according to the second means that includes the cylinder provided on the body and the piston fitting in the cylinder in a manner capable to move in and out freely is supported and assembled onto the discharge cylinder by arranging an axial in parallel to the discharge cylinder on an upper side of an outer circumference of the body, the piston of the pump is interlocked to the grip member via an interlock mechanism arranged on an upper side of the discharge cylinder, and the suction-discharge aperture of the pump is positioned in the internal space of the nozzle on the tip side of the discharge cylinder;

moreover, in addition to this, proposed as a sixth means is a dripping prevention apparatus in a sealer gun, wherein a tip side of a connecting pipe that connects the suction-discharge aperture of the pump according to the first means to the internal space of the nozzle on the tip side of the discharge cylinder is formed in a pipe shape, and is coaxially fit and inserted into the nozzle, and a tip aperture is communicated into the nozzle;

moreover, in addition to this, proposed as a seventh means is a dripping prevention apparatus in a sealer gun, wherein a pressure regulator is assembled onto the tip side of the discharge cylinder according to the first means, the pressure regulator is connected to a pipe line of a connecting pipe connected to the suction-discharge aperture of the pump, and the connecting pipe is communicated to the internal space of the nozzle of the tip of the discharge cylinder;

moreover, in addition to this, proposed as an eighth means is a dripping prevention apparatus in a sealer gun, wherein the pump according to the first means that includes the cylinder provided on the body and the piston fitting in the cylinder in a manner capable to move in and out freely is coaxially arranged inside the discharge cylinder, an outer circumferential side of the cylinder of the pump is fixed onto an inner circumferential side of the discharge cylinder and assembled to inside the discharge cylinder, and the suction-discharge aperture of the pump is opened to the internal space of the nozzle;

moreover, in addition to this, proposed as a ninth means is a dripping prevention apparatus in the sealer gun, wherein onto the operation rod according to the first means interlocked with the piston of the pump that includes the cylinder provided on the body and the piston fitting in the cylinder in a manner capable to move in and out freely, a spring configured to give force so as to operate the piston in a direction of pushing in is assembled so as to be compressed by operation of the operation rod to move in a direction of pulling out by gripping the grip member via the interlock mechanism, and when releasing a grip on the grip member, the grip member is configured to pivot resiliently or to move resiliently caused by a spring pressure of the spring;

moreover, in addition to this, proposed as a tenth means is a dripping prevention apparatus in the sealer gun, wherein onto the operation rod according to the first means interlocked with the piston of the pump that includes the cylinder provided on the body and the piston fitting in the cylinder in a manner capable to move in and out freely, a spring configured to give force so as to operate the piston in a direction of pulling out is assembled so as to be compressed by operation of the operation rod to move in a direction of pushing in by gripping the grip member via the interlock mechanism, and when releasing a grip on the grip member, the grip member is configured to pivot resiliently or to move resiliently caused by a spring pressure of the spring that is compressed;

moreover, in addition to this, proposed as an eleventh means is a dripping prevention apparatus in the sealer gun, wherein the pump according to the first means that includes the cylinder provided on the body and the piston fitting in the cylinder in a manner capable to move in and out freely is coaxially arranged inside the discharge cylinder, a flow path for a liquid material is formed between the cylinder of the pump and an inner circumferential surface of the discharge cylinder, and assembled to inside the body, the suction-discharge aperture of the pump is opened to a space inside the nozzle, the operation rod interlocked with the piston is interlocked to the grip member via the interlock mechanism arranged and provided on an outer circumferential side of the discharge cylinder so as to cause the piston to perform operation of suction and discharge by pivoting by gripping the grip member and by resilient pivoting, a valve mechanism configured to disconnect and to establish communication between the flow path of a liquid material and an introduction pipe by motion of moving into and out from the cylinder is built in the piston, and the valve mechanism controls disconnection and establishment of communication between the introduction pipe and the tip side of the discharge cylinder; and moreover, in addition to this, proposed as a twelfth means is a dripping prevention apparatus in a sealer gun, wherein an aperture diameter d1 of a tip aperture formed on a tip of the nozzle on the tip side of the discharge cylinder according to the first embodiment is formed and provided as an aperture diameter smaller than an inner diameter of the nozzle, and the aperture diameter d1 of the tip aperture of the nozzle is formed and provided so as to establish relation $d1 \leq d2$ between the aperture diameter d1 of the tip aperture and an aperture diameter d2 of the suction-discharge aperture of the pump that is opened to the internal space of the nozzle.

Effect of the Invention

According to embodiments of the present invention, during a coating work and/or a filling work of a liquid material by a sealer gun, when a grip on a grip member is released, the grip member is resiliently operated by a resilient spring, a valve mechanism is closed by the resilient operation and communication between a nozzle and an introduction pipe is shut off, and a discharge of the liquid material from the nozzle is stopped; a pump provided on a discharge cylinder operates in an interlocked manner with resilient operation of the grip member, and performs pump operation; and a suction pressure or a discharge pressure resulting from the pump operation is introduced into the nozzle on a tip side of the discharge cylinder, and acts; so that a drip of the liquid material, arising by sticking on and hanging from a tip portion of the nozzle when a discharge of the liquid material is stopped by releasing a grip on the grip member, can be sucked into a cylinder of the pump or blown away from a tube tip of the nozzle, with the suction pressure or the discharge pressure introduced into the nozzle, and is vanished from the tip portion of the nozzle; therefore a dripping phenomenon can be securely prevented.

MODES FOR CARRYING OUT THE INVENTION

Embodiments according to the present invention will be described below in detail with reference to the accompany drawings with respect to each embodiment.

First Embodiment

Figure 6:
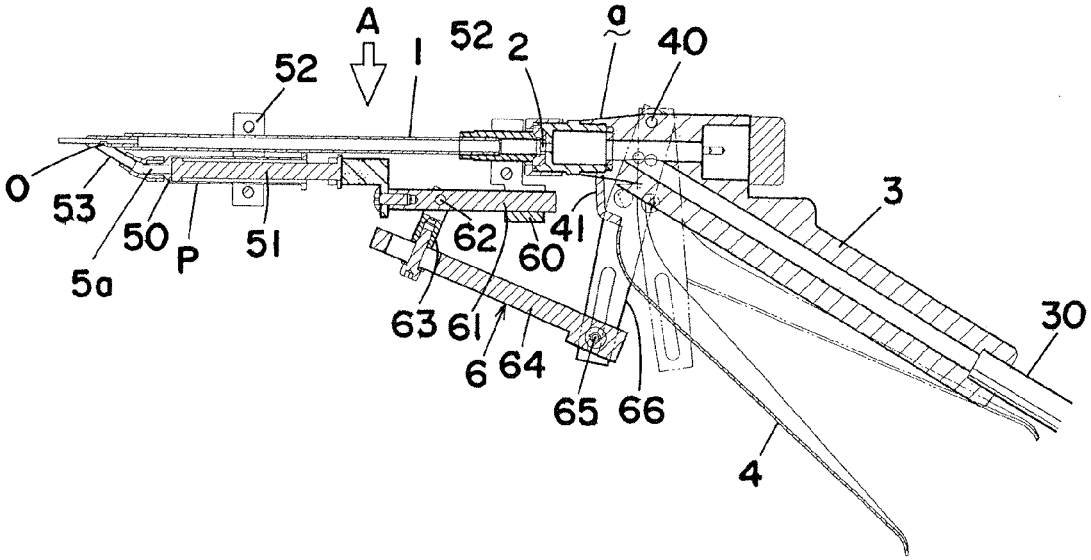
FIG. 6 is a vertical cross-sectional side view of a sealer gun according to an embodiment of the present invention when it is in a state that a grip on a grip member is released.
Figure 7:
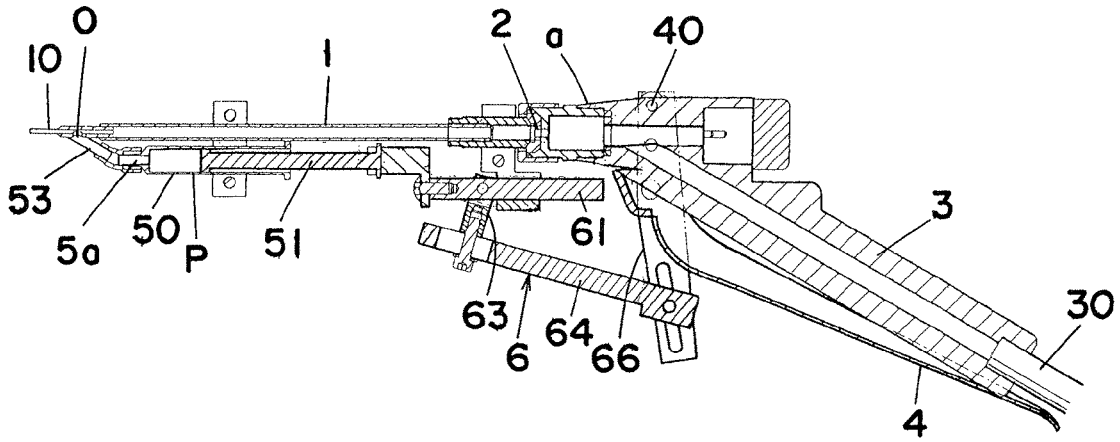
FIG. 7 is a vertical cross-sectional side view of the same sealer gun as the above when it is in a state that the grip member is gripped.

FIG. 6 depicts a vertical cross-sectional side view of a sealer gun that embodies the present invention in a state where a grip on a grip lever that is a grip member is released; and FIG. 7 depicts vertical cross-sectional side view of the same sealer gun as the above in a state where the grip member is gripped.

In the figure, A denotes the whole of a sealer gun; 1 denotes a discharge cylinder; 10 denotes a nozzle that is provided on the tip side of the discharge cylinder 1; and 2 denotes a valve mechanism that is integrated inside the discharge cylinder 1, and accommodated in a main body a that is formed in a cylindrical shape having an enlarged diameter and connected to the base side of the discharge cylinder 1. 3 denotes a holding unit that is provided in a continuously integrated manner to the main body a connected to the base side of the discharge cylinder 1 of the sealer gun A; 4 denotes a grip member that is connected to the base side of the discharge cylinder 1 of the sealer gun A along the holding unit 3, and axially supported from the main body a; P denotes a pump P that includes a cylinder 50 and a piston 51 that are provided to the discharge cylinder 1 of the sealer gun A; and 6 denotes an interlock mechanism that interlocks the piston 51 of the pump P and the grip member 4 described above.

Figure 1:
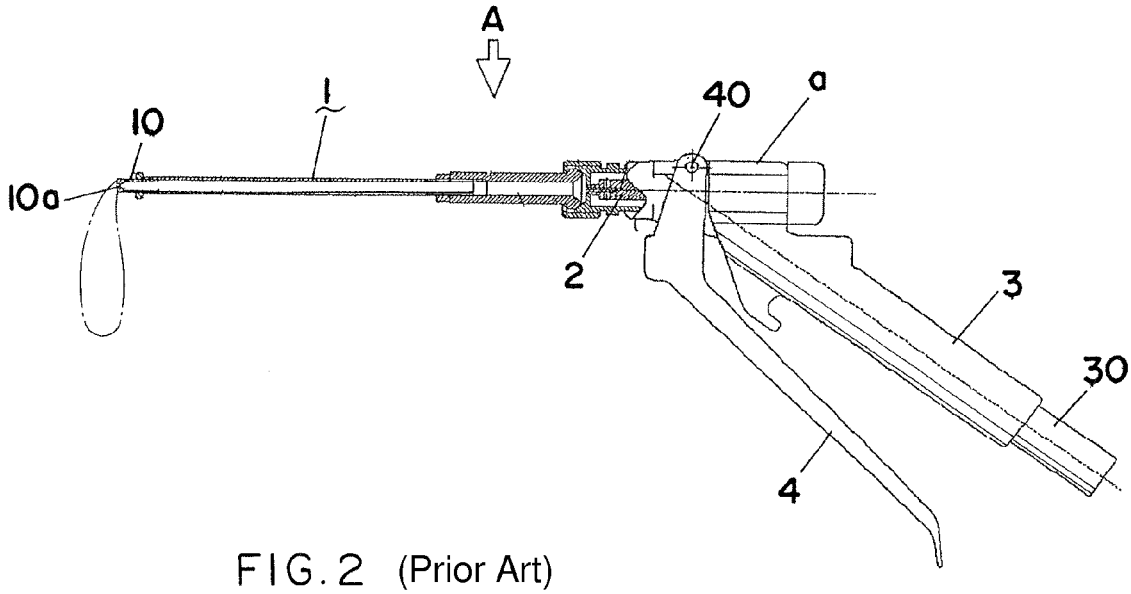
FIG. 1 (Prior Art)
FIG. 1 is a vertical cross-sectional side view of a conventional sealer gun.
Figure 2:
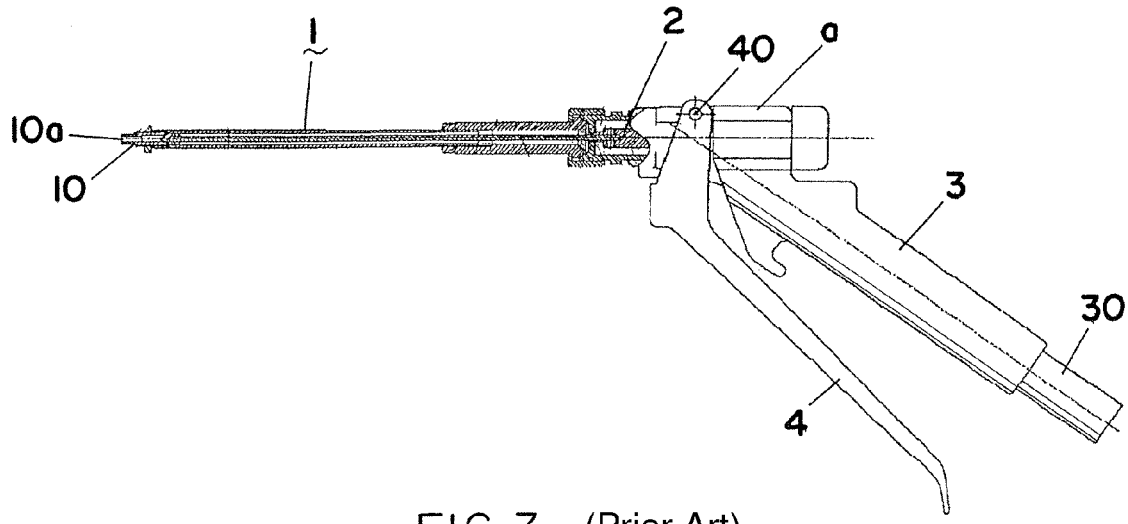
FIG. 2 (Prior Art)
FIG. 2 is a vertical cross-sectional side view of a sealer gun provided with an improvement measure.
Figure 3:
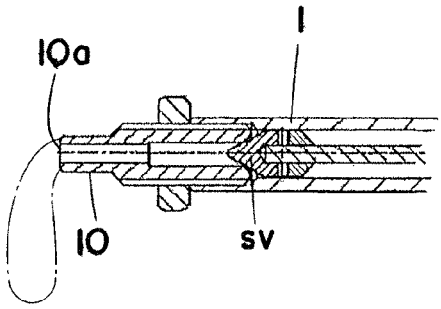
FIG. 3 (Prior Art)
FIG. 3 is an enlarged vertical cross-sectional side view of a tip portion of the same sealer gun as the above.
Figure 4:
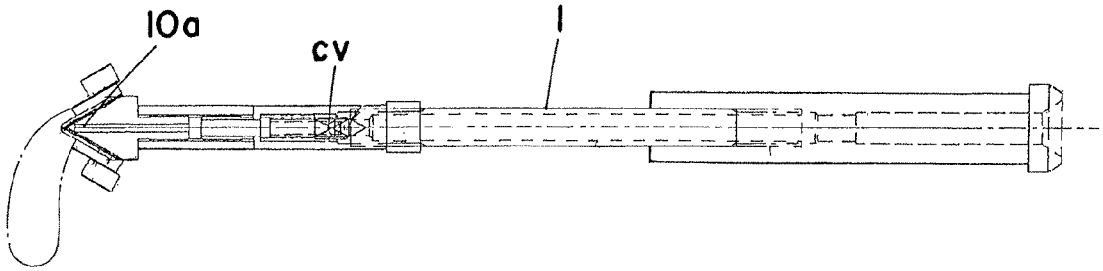
FIG. 4 (Prior Art)
FIG. 4 is a vertical cross-sectional side view of a region of a discharge cylinder of a sealer gun provided with another improvement measure.
Figure 5:
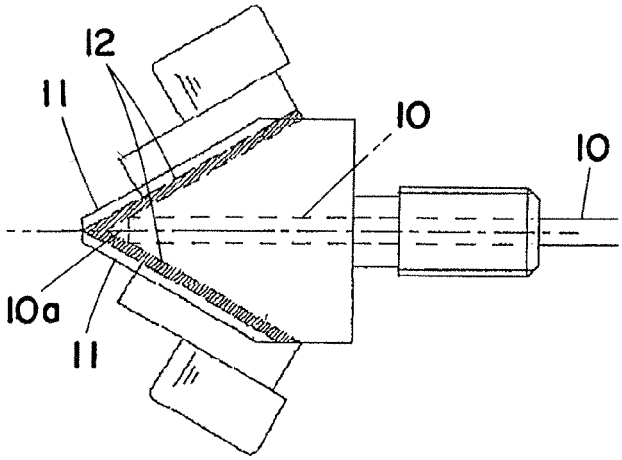
FIG. 5 (Prior Art)
FIG. 5 is an enlarged vertical cross-sectional side view of a tip portion of the discharge cylinder of the same sealer gun as the above.

The sealer gun A is an ordinary sealer gun configured such that the base side of the discharge cylinder 1 provided with the nozzle 10 on the tip side is connected to an inside space of the main body that is formed in a cylindrical shape having a larger diameter than the discharge cylinder 1; the inside space of the main body a is connected to an introduction pipe 30 configured to introduce a liquid material of a coating agent/a filler, the main body a accommodates therein the valve mechanism 2 that is configured to shut off and to establish communication between the introduction pipe 30 and the nozzle 10 of the tip of the discharge cylinder 1, and the main body a is provided with the holding unit 3 that is formed in a continuously integrated manner; the grip member 4 is axially supported to the main body a with a spindle 40 along the holding unit 3; the grip member 4 is interlocked to the valve mechanism 2 accommodated in the main body a described above via an interlock means such that the valve mechanism 2 turns open upon gripping the grip member 4 together with the holding unit 3 and then letting it pivot or move to a position in a state along the holding unit 3, and the valve mechanism 2 turns closed upon releasing a grip on the grip member 4 and letting the grip member 4 resiliently operate by a resilient spring (not shown) to an open position separate from the holding unit 3; and accordingly, when gripping the grip member 4, a liquid material that is sent and supplied into the discharge cylinder 1 via the introduction pipe 30 by being pressurized is forced to discharge from the nozzle 10 on the tip side of the discharge cylinder 1; and when releasing the grip member 4, communication between the introduction pipe 30 and the nozzle 10 on the tip side of the discharge cylinder 1 is shut off, and a discharge of the liquid material from the nozzle 10 is stopped; so that its configuration is not different from that of a conventional sealer gun shown in FIG. 1, and the holding unit 3 is shaped so as to enfold the introduction pipe 30 connected to the discharge cylinder 1 and to extend continuously in an integrated manner with the main body a.

The pump P is a pump of an ordinary cylinder type that includes the cylinder 50 and the piston 51 that fits in the cylinder 50 in a manner capable to move in and out freely by sliding, discharges air inside the cylinder 50 from a suction-discharge pipe 5*a* provided in a cylindrical shape on the tip side of the cylinder 50 as the piston 51 is pushed into the cylinder 50, and sucks air from the suction-discharge pipe 5*a* into the cylinder 50 as the piston 51 is pulled out; and it is arranged in parallel with the discharge cylinder 1 of the sealer gun A, in an attitude such that the suction-discharge pipe 5*a* on the tip side is positioned forward and the piston 51 on the base side projects rearward; and the cylinder 50 is assembled onto the discharge cylinder 1 supported by a mounting member 52. The suction-discharge pipe 5*a* on the tip side of the cylinder 50 is connected via a connecting pipe 53 to a communication aperture O that is open and provided to a tube wall of the nozzle 10 connected to the tip of the discharge cylinder 1 of the sealer gun A, and it is configured to apply a negative pressure or a positive pressure into the nozzle 10 by pump operation owing to forward-rearward motion of the piston 51 with respect to the cylinder 50.

The interlock mechanism 6 is a mechanism that interlocks the piston 51 and the grip member 4 so as to perform pump operation of suction-discharge by the pump P in a synchronized manner with the pivoting operation of the grip member 4 described above; includes an operating rod 61 that is coupled to the base side of the piston 51 and moves forward and rearward in parallel with the discharge cylinder 1 by being guided by a guide cylinder 60 assembled and supported on the base side of the discharge cylinder 1 with the mounting member 52, an interlock rod 63 that is coupled to the operating rod 61 via a joint spindle 62, a first link rod 64 of which tip side is connected to the interlock rod 63 in a state that tilting-pivoting is allowed owing to a long hole, and a second link rod 66 of which the base side is connected via a long hole to an interlock spindle 65 provided on the base side of the first link rod 64 and the base side is coupled to the grip member 4 in an integrated manner; and is configured such that when the grip member 4 pivots to the position along the holding unit 3 as shown in FIG. 7, the first link rod 64 is pulled rearward as the second link rod 66 pivots rearward together with the grip member 4, accordingly the operating rod 61 slides rearward and moves the piston 51 in a direction to be pulled out and causes the cylinder 50 to perform suction operation, and when by releasing a grip on the grip member 4, the grip member 4 resiliently pivots by the resilient spring to a position in a state in FIG. 6 at which it stops by butting against a stopper 41 beneath an enlarged diameter part 1*a*, resulting from this pivoting, the second link rod 66 pivots forward and pushes out the first link rod 64 forward, moves the operating rod 61 forward and pushes the piston 51, and causes the cylinder 50 to perform discharge operation.

The pump P according to the embodiment is set such that when it is in a state that the grip member 4 is gripped, owing to the interlock mechanism 6, the piston 51 occupies a position at which the piston 51 is pulled out, and when releasing a grip on the grip member 4, the piston 51 is pushed in resulting from operation of resilient pivoting of the grip member 4 and discharge operation is performed.

Accordingly, if a discharge of a liquid material is stopped by releasing the grip member 4, the pump P blows air into the nozzle 10 of the tip of the discharge cylinder 1, blows away from the nozzle 10 a liquid material sticking to and hanging from the nozzle 10 with a blowing-out pressurized air flow, and eliminates dripping of the liquid material sticking and remaining on the tip of the nozzle 10.

Second Embodiment

Figure 8:
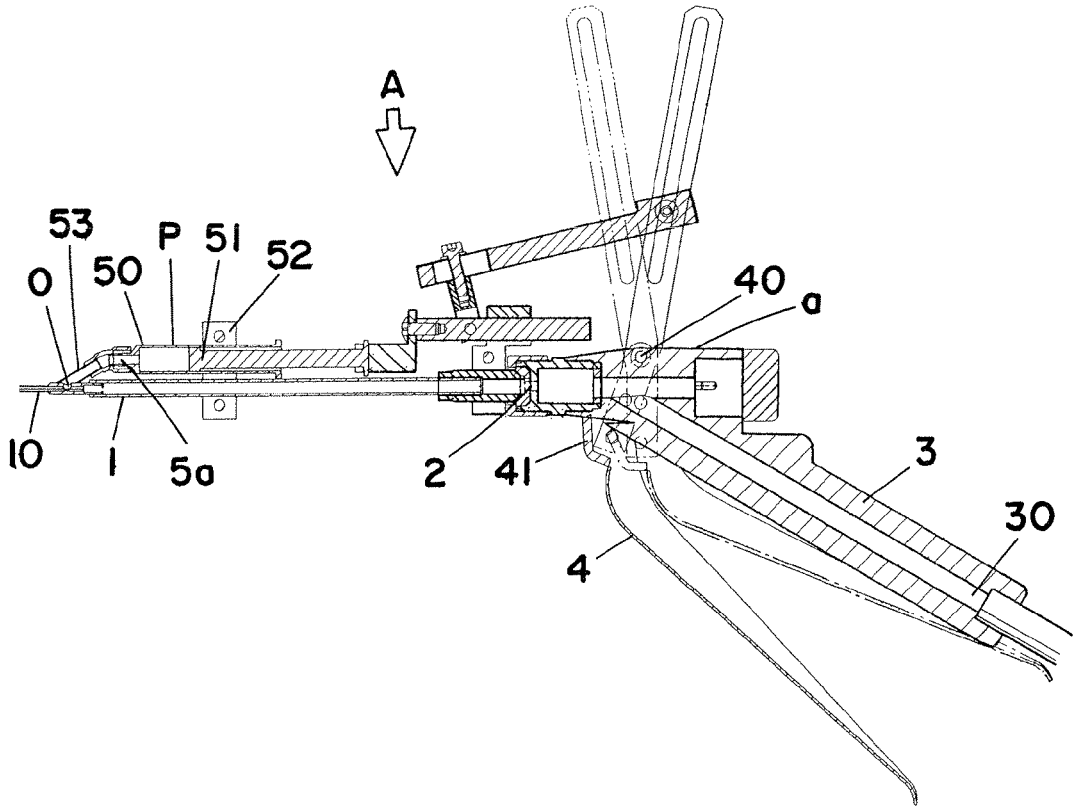
FIG. 8 is a vertical cross-sectional side view of a sealer gun according to another embodiment of the present invention when it is in a state that a grip member is released.
Figure 9:
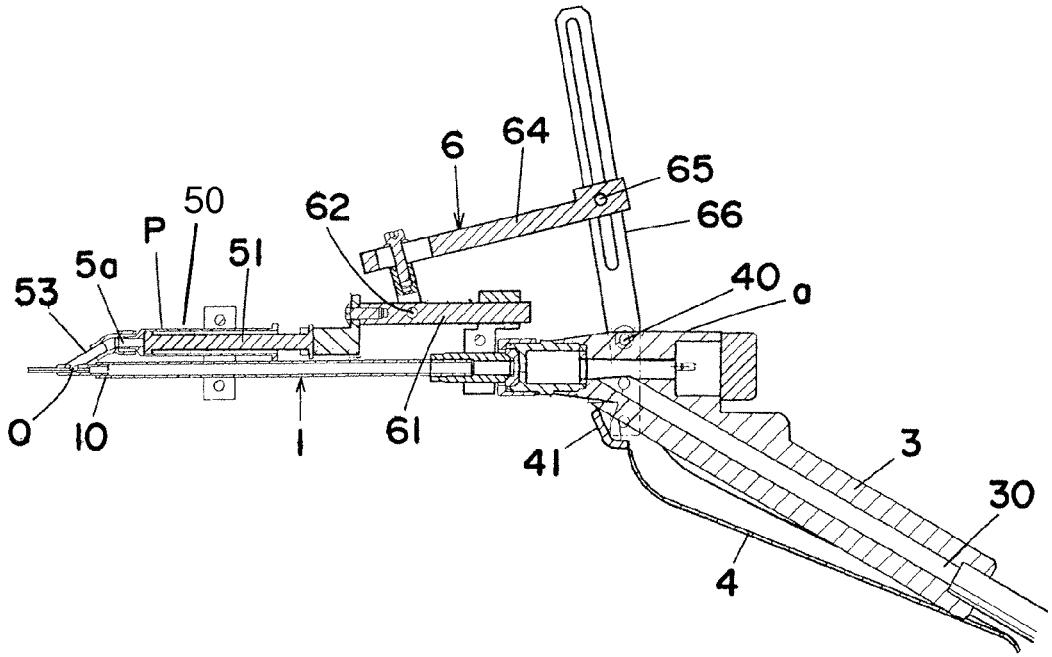
FIG. 9 is a vertical cross-sectional side view of the same embodiment as the above when it is in a state that the grip member is gripped.

FIGS. 8 and 9 depict a second embodiment. In contrast to the first embodiment described above configured such that a positive pressure acts for the pump P to blow air into the nozzle 10 resulting from operation of resilient pivoting of the grip member 4 when a discharge of a liquid material is stopped by releasing a grip on the grip member 4; this embodiment is an example configured such that a negative pressure acts for the pump P to perform suction operation to an internal space of the nozzle 10 when a discharge of a liquid material is stopped by releasing a grip on the grip member 4.

In the figure, A denotes the whole of a sealer gun; 1 denotes a discharge cylinder of the sealer gun A; 10 denotes a nozzle that is provided on the tip side of the discharge cylinder 1; a denotes a main body that is formed in a hollow cylindrical shape and is connected to the base side of the discharge cylinder 1; 2 denotes a valve mechanism that is accommodated in the main body a; 3 denotes a holding unit that is provided continuously to the main body a; 30 denotes an introduction pipe that is provided so as to introduce a liquid material into the discharge cylinder 1; 4 denotes a grip member that is axially supported from the main body a along the holding unit 3 so as to pivot forward and rearward around a joint spindle 40 as a pivot; P denotes a pump that is arranged in parallel onto the outer side of the discharge cylinder 1 of the sealer gun A and is assembled onto the outer side of the discharge cylinder 1 with the mounting member 52; and 6 denotes an interlock mechanism that interlocks the pump P and the grip member 4 of the sealer gun A.

These are configured similarly to those according to the first embodiment described above; the pump P is an ordinary pump that includes the cylinder 50 and the piston 51 that fits in the cylinder 50 in a manner capable to move in and out freely; the tip side of a suction-discharge pipe 5*a* formed and provided on the tip side of the cylinder 50 is connected via the connecting pipe 53 to the communication aperture O that is open and provided to a tube wall of the nozzle 10 of the tip of the discharge cylinder 1; and the interlock mechanism 6 includes the operating rod 61 that is coupled to the base side of the piston 51 of the pump P, the first link rod 64 that is interlocked to the operating rod 61 via the interlock rod 63, and the second link rod 66 that is provided in an integrated manner with the grip member 4 and is interlocked to the first link rod 64 via the interlock spindle 65.

However, when causing the pump P to perform pump operation owing to operation of resilient pivoting of the grip member 4, according to the first embodiment described above, it is configured to perform discharge operation, in contrast, according to this embodiment, it is configured to perform suction operation, therefore the second link rod 66 of the interlock mechanism 6 configured to be mounted and provided by being coupled in an integrated manner with the grip member 4 is mounted and provided onto the grip member 4 in a form such that an upper portion beyond the joint spindle 40 of the grip member 4 is projected from the upper side of the main body a so as to extend upward.

Furthermore, the pump P and the interlock mechanism 6 are configured such that the both are arranged on the upper side of the discharge cylinder 1, and are mounted and supported to the discharge cylinder 1 with the mounting member 52, accordingly, it is configured such that a motion of the second link rod 66 coupled to and supported by the grip member 4 when releasing a grip on the grip member 4 is to be a motion of pivoting rearward, the piston 51 of the pump P is moved in a direction of pulling it out via the interlock mechanism 6, and suction operation is given to the pump P.

Accordingly, the sealer gun according to the embodiment is configured such that when a discharge of a liquid material is stopped by releasing the grip member 4, the pump P performs suction operation, draws into the cylinder 50 a dripping liquid material arising on the tip side of the nozzle 10 of the discharge cylinder 1, and eliminates dripping arising on the tip of the nozzle 10.

Third Embodiment

Figure 10:
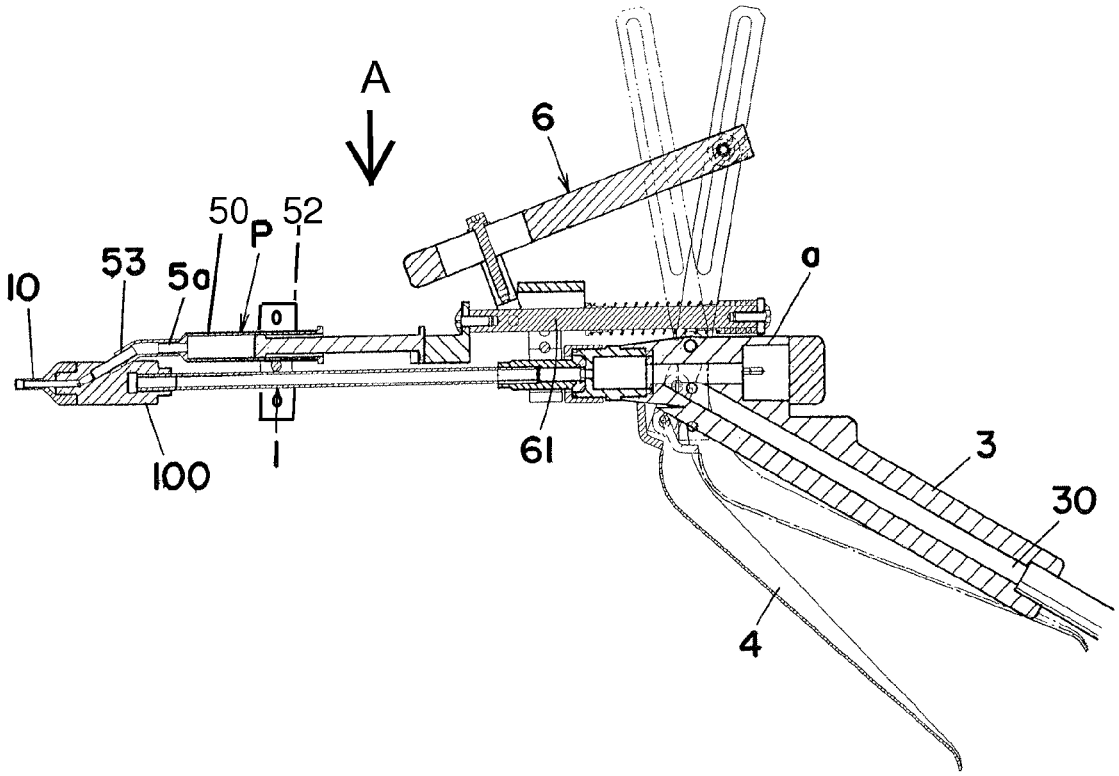
FIG. 10 is a vertical cross-sectional side view of a sealer gun according to still another embodiment of the present invention when it is in a state that a grip member is gripped.
Figure 11:
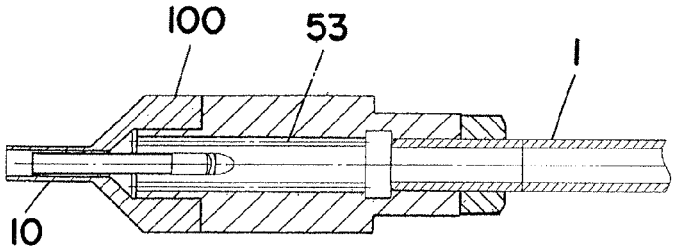
FIG. 11 is an enlarged horizontal cross-sectional plan view of a tip portion of a discharge cylinder of the same embodiment as the above.

FIGS. 10 and 11 depict still another embodiment. This embodiment is an example configured such that the pump P is assembled and provided onto the sealer gun A so as to operate in an interlocked manner by a motion of resilient pivoting when releasing a grip on the grip member 4; when a discharge of a liquid material by the sealer gun A is stopped by releasing a grip on the grip member 4, the pump P that is assembled and provided is caused to perform operation of suction or discharge; a negative pressure or a positive pressure resulting from the operation is applied into the nozzle 10 of the tip of the discharge cylinder 1 of the sealer gun A, thereby sucking or pushing out, and eliminating dripping of a liquid material sticking and arising on the tip side of the nozzle 10; and a modification is added to a connection-communication means between the suction-discharge pipe 5*a* provided on the tip side of the cylinder 50 of the pump P and an internal space of the nozzle 10.

Precisely, it is similar to the one according to the first and second embodiments described above with respect to aspects that the pump P is assembled on the outer side of the discharge cylinder 1 with the mounting member 52, the suction-discharge pipe 5*a* on the tip side of the cylinder 50 is connected to the connecting pipe 53, and the connecting pipe 53 is connected to the nozzle 10; however, it is an example that the tip side of the connecting pipe 53 is connected to a nozzle mounting unit 100, as shown in FIG. 11, so as to enfold coaxially the base side of the nozzle 10 from the outer circumferential side, and communication to the nozzle 10 is established via a gap between the inner circumferential surface of the nozzle 10 and the outer circumferential surface of the connecting pipe 53.

The connection-communication means between the connecting pipe 53 and the nozzle 10 according to the embodiment shows an example that it is applied the sealer gun A that is set so as to perform suction operation as pump operation of the pump P resulting from resilient pivoting of the grip member 4 when a discharge of a liquid material is stopped by releasing a grip on the grip member 4; however, even if it is applied to a sealer gun of which the interlock mechanism 6 is changed so as to perform discharge operation by pushing out the operating rod 61 caused by operation of resilient pivoting of the grip member 4, similarly to the first embodiment, there is no difference in functions and actions.

Fourth Embodiment

Figure 12:
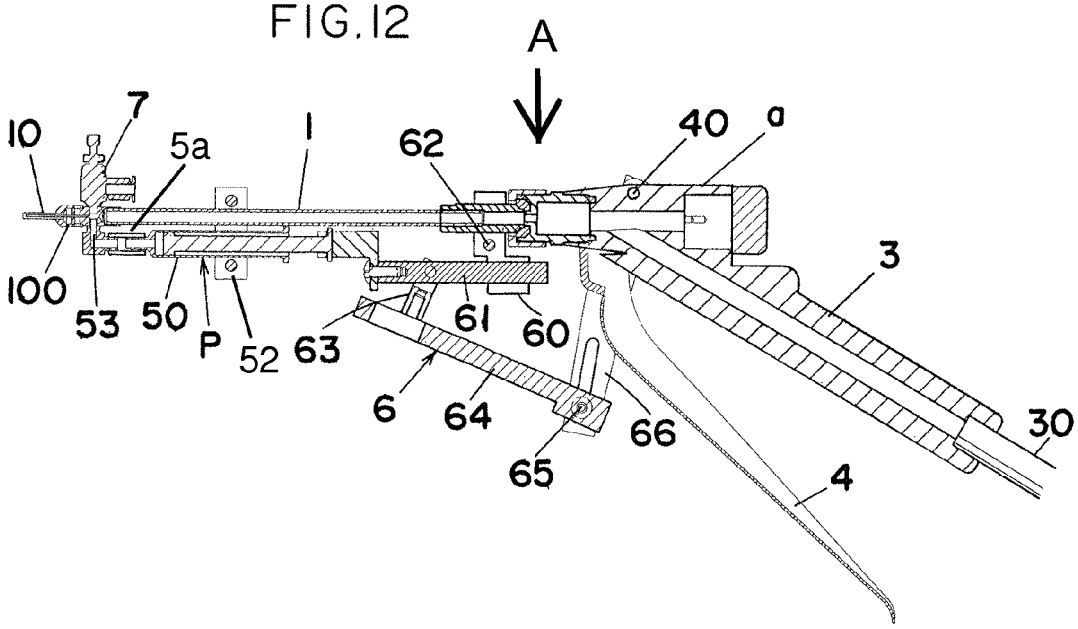
FIG. 12 is a side view of still another embodiment according to the present invention.
Figure 13:
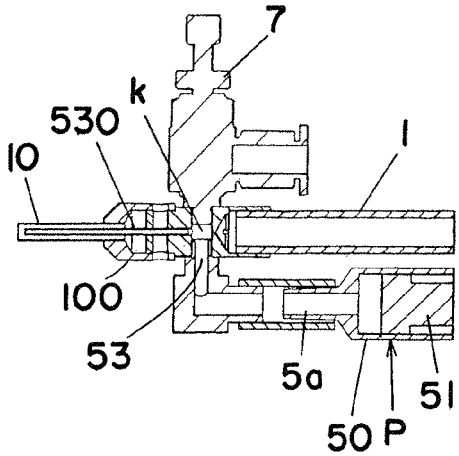
FIG. 13 is an enlarged vertical cross-sectional side view of a tip portion of a discharge cylinder of the same embodiment as the above.
Figure 14:
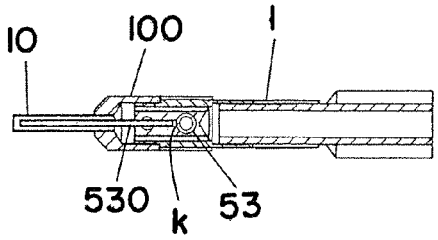
FIG. 14 is an enlarged horizontal cross-sectional plan view of the tip portion of the discharge cylinder of the same embodiment as the above.
Figure 15:
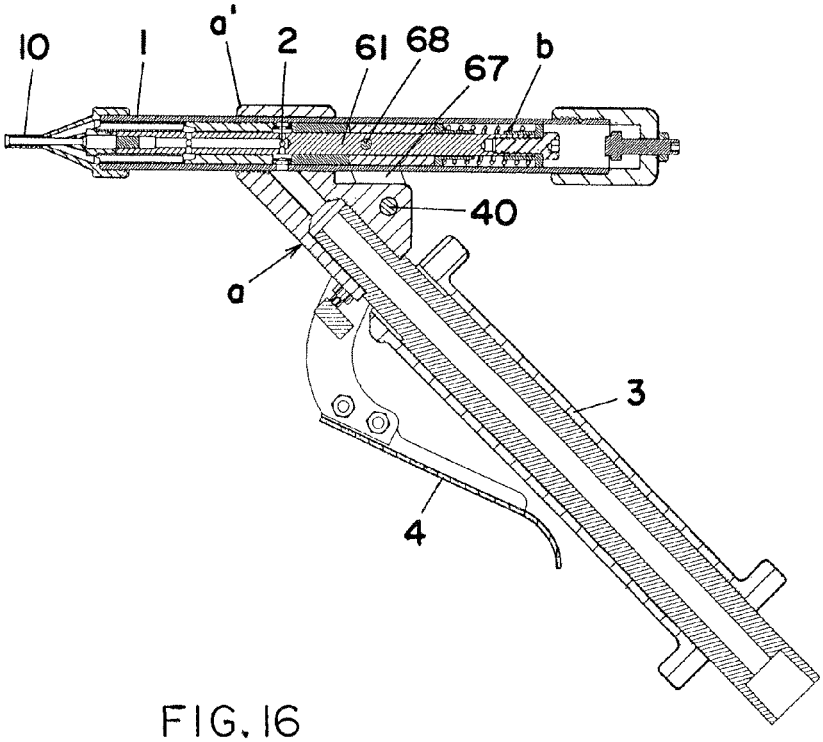
FIG. 15 is a vertical cross-sectional side view of still another embodiment when it is in a state that a grip member pivots or moves to a position at which the grip member is gripped, and opens a valve mechanism.
Figure 16:
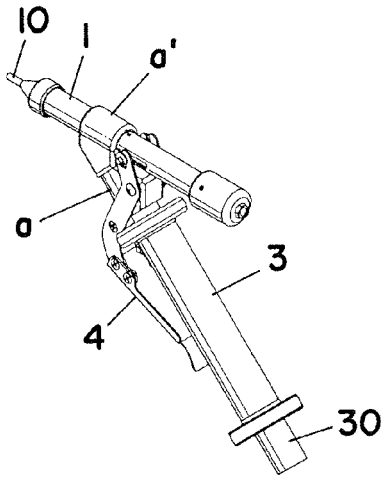
FIG. 16 is a perspective view of the same embodiment in the same state as the above.

FIGS. 12 to 14 depict still another embodiment. This embodiment is an example configured such that the pump P that operates discharge or suction caused by a motion of resilient operation of the grip member 4 is assembled and provided onto the sealer gun A, and a unit that applies a pressure caused by operation of the pump P into the nozzle 10 of the tip of the discharge cylinder 1 is configured such that a discharge pressure or a suction pressure of a fluid produced by operation of the piston 51 of the pump P can be desirably regulated and set by a pressure regulator 7 that is assembled and provided.

In the figure, the reference numeral 7 denotes the pressure regulator, which uses a speed controller that is commercially available. The pressure regulator 7 is arranged on an opposite side of the discharge cylinder 1 against the cylinder 50 of the pump P and assembled onto the nozzle mounting unit 100 of the discharge cylinder 1; the connecting pipe 53 connected to the suction-discharge pipe 5*a* of the cylinder 50 is extended across an internal space of the nozzle mounting unit 100, and is connected to the pressure regulator 7; an opening k is opened in a region positioned in the nozzle mounting unit 100 and at some midpoint in the connecting pipe 53; and the opening k is made to face the base side of a discharge pipe 530 that is fit and inserted by being coaxially positioned in the internal space of the nozzle 10; so that a discharge pressure or a suction pressure of the pump P regulated by the pressure regulator 7 can act on both of the internal space of the nozzle mounting unit 100 and the discharge pipe 530.

According to this unit, a pressure of air acting on the inside of the nozzle 10 by operation of the pump P can be regulated to a desired pressure by the pressure regulator 7.

Fifth Embodiment

FIGS. 15 to 23 depict still another embodiment. This embodiment is an example configured such that the pump P provided to the discharge cylinder 1 is integrated inside the discharge cylinder 1, so that it is provided to the discharge cylinder 1 as a built-in type.

In the figure, 1 denotes a discharge cylinder that is formed in a barrel shape and equipped with the nozzle 10 on the tip side. The discharge cylinder 1 is assembled and supported onto the main body a in an integrated manner, by fitting the outer circumferential side of a cylinder wall of the discharge cylinder 1 to the inner circumferential side of an shank barrel unit a' that is formed and provided on the upper end side of the main body a that is separately shaped. It is connected and communicated to the introduction pipe 30 that is enfolded inside the main body a via a communication aperture 80 that is opened and provided in a region opposite to the inner circumferential surface of the shank barrel unit a' described above on the cylinder wall of the discharge cylinder 1, and is configured so as to discharge from the nozzle 10 on the tip side a liquid material that is introduced from the introduction pipe 30 via the communication aperture 80.

Figure 17:
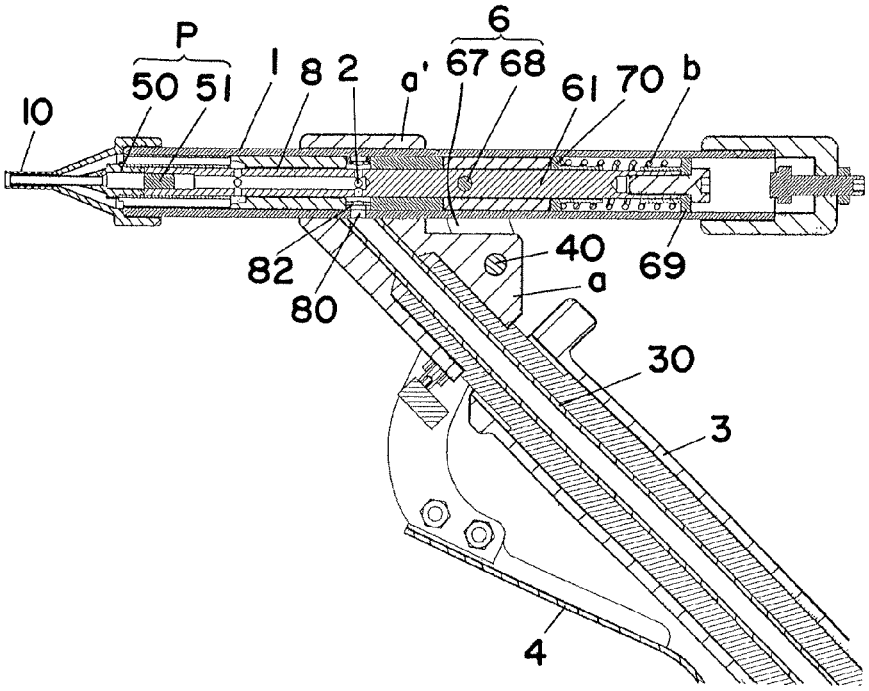
FIG. 17 is an enlarged vertical cross-sectional side view of a relevant region of the same embodiment in the same state as the above.
Figure 23:
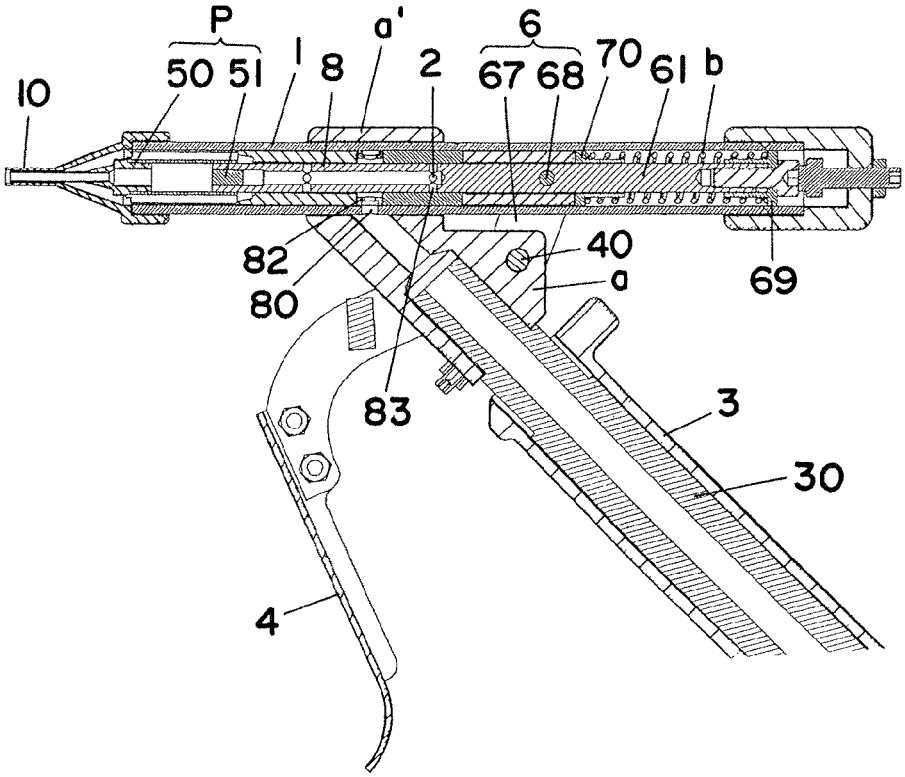
FIG. 23 is an enlarged vertical cross-sectional side view of a relevant region of the same embodiment in the same state as the above.

2 denotes a valve mechanism that controls open and close of communication to the nozzle 10 of the tip of the discharge cylinder 1 of the introduction pipe 30. The valve mechanism 2 is a valve mechanism that is arranged to the main body a on the forward side of the holding unit 3 and axially supported with the joint spindle 40; that is configured to operate to open in a synchronized manner with pivoting when pivoting the grip member 4 to a position along the holding unit 3 as shown in FIG. 17 by gripping the grip member 4 that is provided to be capable to be gripped together with the holding unit 3, and then to send a liquid material from the introduction pipe 30 into the discharge cylinder 1 and to discharge it from the nozzle 10 of the tip of the discharge cylinder 1; and that is configured to operate to close in a synchronized manner with a motion of pivoting or shifting when the grip member 4 pivots or shifts to a position separate from the holding unit 3 as shown in FIG. 23 caused by operation of a resilient spring b resulting from a release of a grip, and then to stop inflow of the liquid material into the discharge cylinder 1 and to stop a discharge of a liquid material from the nozzle 10 of the tip of the discharge cylinder 1.

Figure 19:
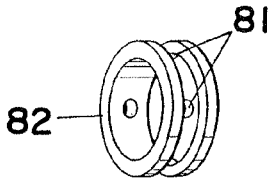
FIG. 19 is a perspective view of a valve seat member integrated in the same valve mechanism portion according to the same embodiment as the above.

The valve mechanism 2 is configured such that, as shown in FIG. 19, a valve seat 82 in a ring shape, on which transparent holes 81 penetrating between inside and outside are circumferentially provided in parallel with a multitude of them, is fixed and provided on a position inside the communication aperture 80 opened on the cylinder wall described above; and a valve shank 8 in which an empty room 84 is formed via a communication hole 83 to an internal space of the discharge cylinder 1, and valve openings 85 that communicate with the empty room 84 are opened and provided on a circumferential wall, is arranged and provided on the inner circumferential side of the valve seat 82 in a ring shape in a manner movable in the axial direction of the discharge cylinder 1; caused by a motion of the valve shank 8 in the axial direction, as the valve opening 85 occupies a position opposite to the valve seat 82 of the ring, communication between the introduction pipe 30 and the inside of the discharge cylinder 1 is open, and the communication is closed as the valve opening 85 occupies a position off from the valve seat 82.

The valve shank 8 is provided with the operating rod 61 that is accommodated movably in the axial direction of the discharge cylinder 1 in a rear extended portion of the discharge cylinder 1, by mounting it on the rear end side in a continuously integrated manner; the operating rod 61 is interlocked with the grip member 4 via the interlock mechanism 6 that includes a link rod 67 provided onto the upper portion beyond the joint spindle 40 of the grip member 4 by being coupled in an integrated manner, and a joint spindle 68 that connects a projected end of the link rod 67 to the operating rod 61; and the operating rod 61 is provided with a spring b configured to give a force in a direction of pulling rearward by arranging it and letting it act between a spring strike plate 69 provided at the rear end of the operating rod 61 and a spring strike plate 70 fixed and provided on the inner surface side of the discharge cylinder 1; when gripping the grip member 4, the link rod 67 pivots forward with respect to the joint spindle 40, thereby pushing the valve shank 8 forward against a given force of the spring b, so that the valve openings 85 occupy an open position facing to the valve seat 82; when releasing a grip on the grip member 4, a resilient force of the spring b that is pushed and compressed as described above moves rearward the operating rod 61 and the valve shank 8 coupled to this, resulting in a close state that the valve opening 85 provided on the valve shank 8 occupy position off the valve seat 82; and at that time, the grip member 4 is caused to pivot resiliently to an open position separate from the holding unit 3 owing to a resilient force of the spring b described above by using the spring b as a resilient spring.

Figure 18:
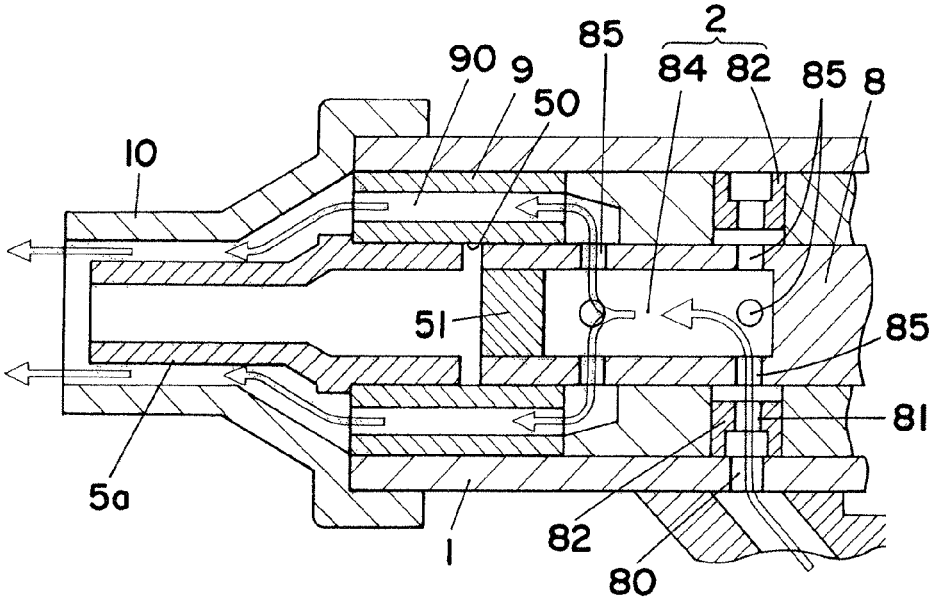
FIG. 18 is an enlarged vertical cross-sectional side view of a valve mechanism portion according to the same embodiment in the same state as the above.
Figure 20:
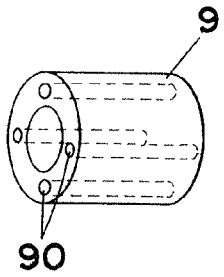
FIG. 20 is a perspective view of a piston of a pump integrated in a discharge cylinder according to the same embodiment as the above.
Figure 21:
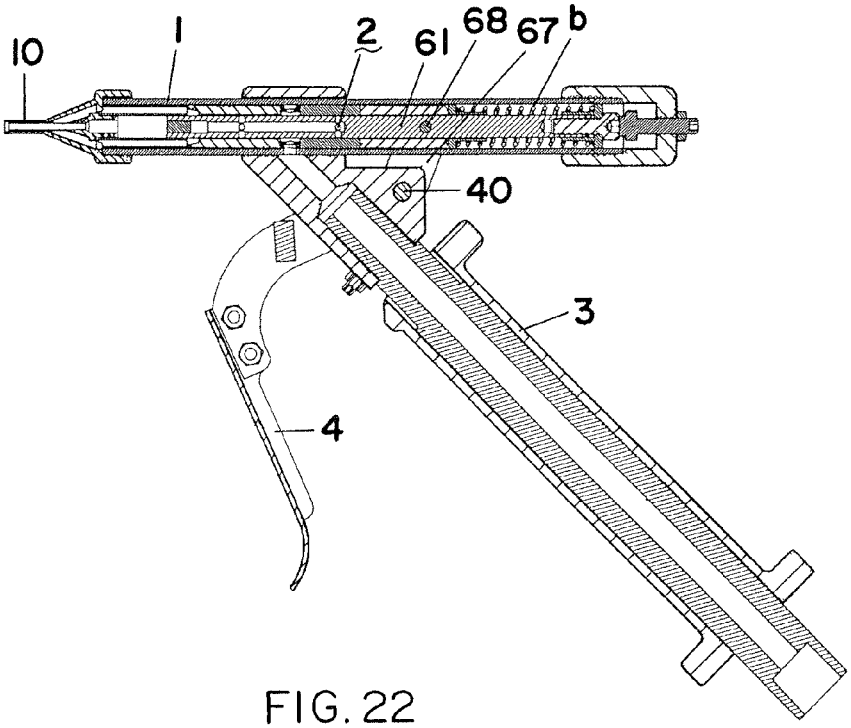
FIG. 21 is a vertical cross-sectional side view of the same embodiment as the above when it is in a state that a grip on the grip member is released, the grip member is resiliently pivoted by a resilient sprint, and the valve mechanism is closed.
Figure 22:
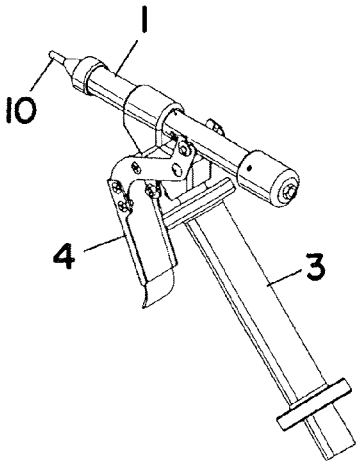
FIG. 22 is a perspective view of the same embodiment in the same state as the above.

P denotes a pump that is attached and provided onto the discharge cylinder 1 in order to apply a positive pressure or a negative pressure into the nozzle 10 when a discharge of a liquid material from the nozzle 10 of the tip of the discharge cylinder 1 is stopped by releasing a grip on the grip member 4 and operating the valve mechanism 2 to close by a motion of resilient pivoting of the grip member 4, and which is an ordinary pump including the cylinder 50 and the piston 51; according to the embodiment, the cylinder 50 is arranged in the center portion on the tip side inside the discharge cylinder 1 coaxially with the discharge cylinder 1, its outer circumferential surface is fit and attached with a flow-path holding member 9 in a cylindrical shape that includes flow paths 90 for a liquid material penetrating forward and rearward as shown in FIGS. 18 and 20, and the inner circumferential side of the cylinder wall of the flow-path holding member 9 is slidably fit and mounted with the tip side of the valve shank 8 that forms a piston by holding the piston 51, thereby forming the cylinder 50 with the inner circumferential surface of the flow-path holding member 9.

The forward end side of the inner circumferential surface of the flow-path holding member 9 in a cylindrical shape forming the cylinder 50 is fit and attached with a diameter-expanded base portion of the suction-discharge pipe 5*a*; the tip side of the suction-discharge pipe 5*a* is plunged into the nozzle 10 of the discharge cylinder 1; and the tip aperture is opened in a region near the tip in the internal space of the nozzle 10; so that the pump P is integrated inside the discharge cylinder 1.

When the sealer gun A according to the embodiment is brought into a state shown in FIG. 17 by gripping the grip member 4, along with the pivoting operation of the grip member 4 in an interlocked manner, the operating rod 61 is pushed forward (leftward in the figure) while compressing the resilient spring b, and the valve shank 8 is pushed in together with this in an integrated manner, accordingly the valve opening 85 of the valve mechanism 2 moves to a position facing to the valve seat 82, so that the valve mechanism 2 turns to an open state, thereby letting a liquid material guided through the introduction pipe 30 flow into the nozzle 10 from the communication aperture 80, via the valve seat 82→the valve opening 85→the empty room 84→the communication hole 83→the flow path 90, as depicted by a thick arrow in FIG. 18, and then discharging it from a tip aperture of the nozzle 10.

If releasing a grip on the grip member 4 from this state, the operating rod 61 moves rearward caused by a resilient force of the spring b that has been compressed, and the valve shank 8 moves together with this, accordingly the valve opening 85 becomes off the position facing to the valve seat 82 and is closed, so that the valve mechanism 2 is closed, thereby shutting off inflow of the liquid material into the discharge cylinder 1, and stopping a discharge of the liquid material from the tip aperture 10*a* of the tip of the discharge cylinder 1.

At that time, as the piston 51 formed on the tip side of the valve shank 8 moves rearward together with the valve shank 8 that moves rearward by a resilient force of the spring b, it operates so as to be pulled out from the cylinder 50, and causes the pump P to operate suction, so that a resultant suction pressure is caused to act inside the nozzle 10 of the tip of the discharge cylinder 1. Owing to this suction pressure, dripping of a liquid material that arises by sticking on and hanging from the tip of the nozzle 10 upon stopping a discharge of the liquid material is pulled into the cylinder 50 via the nozzle 10, and such dripping is eliminated from areas around the tip portion of the nozzle 10.

The sealer gun of a built-in pump type according to the embodiment is configured such that when releasing the grip member 4, the pump P performs suction operation; however, if it is configured such that the operating direction of the operating rod 61 when gripping and pivoting the grip member 4 is reversed to this example, the spring b is to be pulled and extended when operating the operating rod 61, and the pump P is to perform discharge operation by resilient pivoting when releasing the grip member 4, a positive pressure by the pump P acts on the inside of the nozzle 10 upon stopping a discharge of a liquid material, so that dripping is eliminated by blowing it away with air.

Sixth Embodiment

FIGS. 24 to 27 depict still another embodiment. The embodiment is an example that a bore d1 of the tip aperture

10*a* of the nozzle 10 of the discharge cylinder 1 is formed to be equal to or smaller than a bore d2 of a suction-discharge aperture of the tip of the suction-discharge pipe 5*a* of the pump P arranged in the internal space of the nozzle 10 so that d1≤d2; when the pump P assembled to the discharge cylinder 1 performs suction operation by retraction of the piston 51 by releasing a grip on the grip member 4, the pump P generates a negative internal pressure in the internal space of the nozzle 10 of the tip of the discharge cylinder 1 onto a region in the vicinity of the tip aperture 10*a* of the nozzle 10; with the internal pressure, a base portion of a drip of a sealer S sticking to the tip portion of the nozzle 10 and hanging like an icicle, which is sticking to the tip portion of the nozzle 10, is pulled into the nozzle 10, and the sealer S hanging like an icicle is cut off at the base like tearing, so that the sealer S in icicle is separated from the nozzle 10 and let fall.

Except that configurations of a region of the tip aperture 10*a* of the nozzle 10 on the tip side of the discharge cylinder 1 and a region of the suction-discharge aperture of the pump P positioned in the internal space of the nozzle 10 are modified from that according to the fifth embodiment described above, the other configurations are basically not different from those according to the fifth embodiment.

Figure 24:
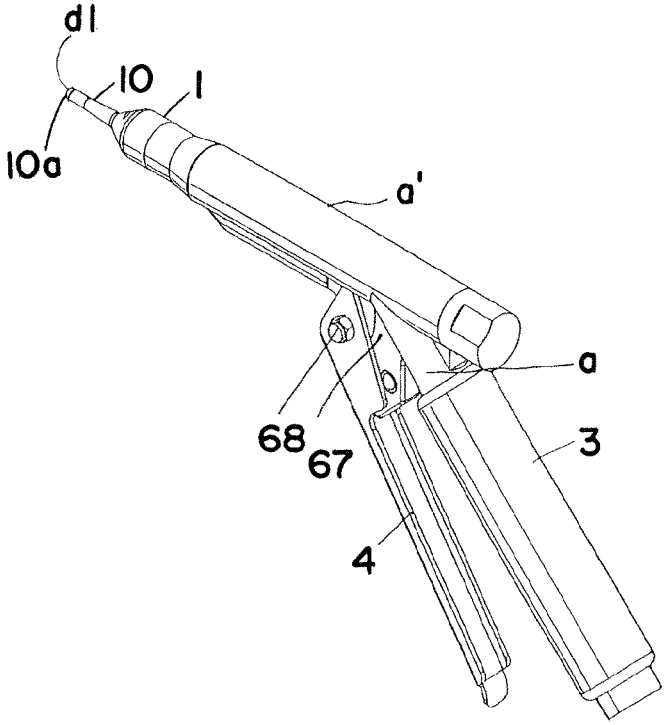
FIG. 24 is a perspective view of still another embodiment according to the present invention.
Figure 25:
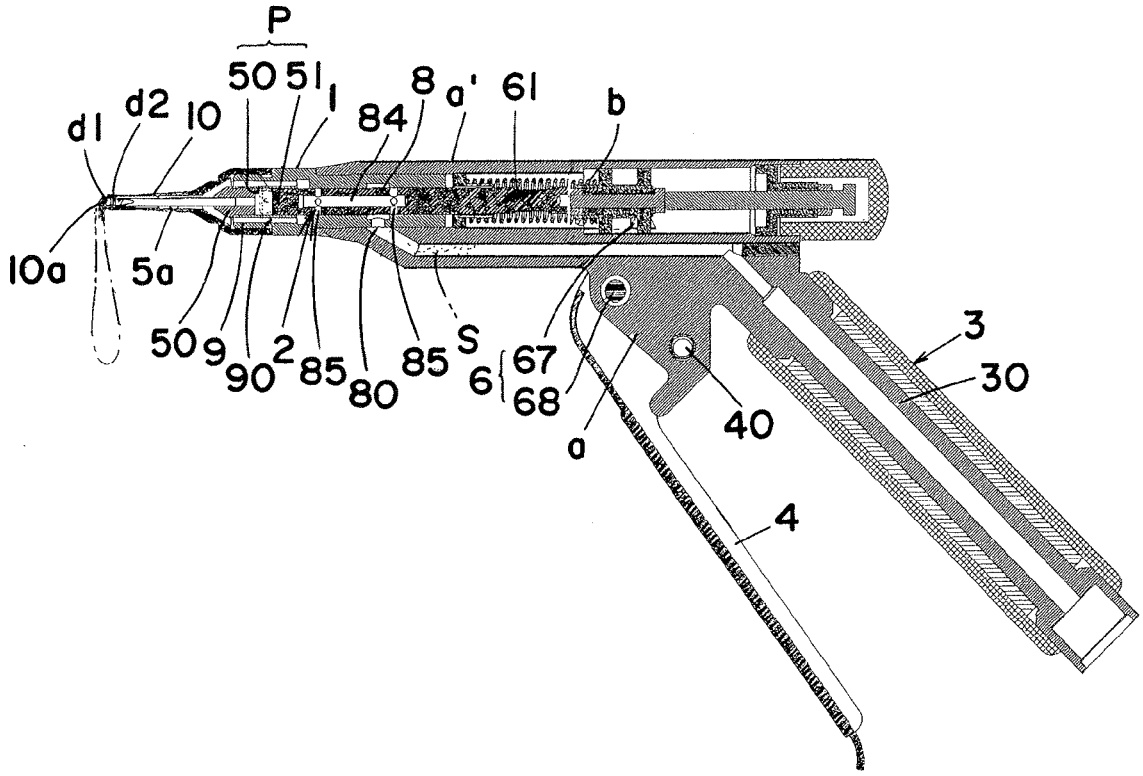
FIG. 25 is a vertical cross-sectional side view of the same embodiment as the above.
Figure 26:
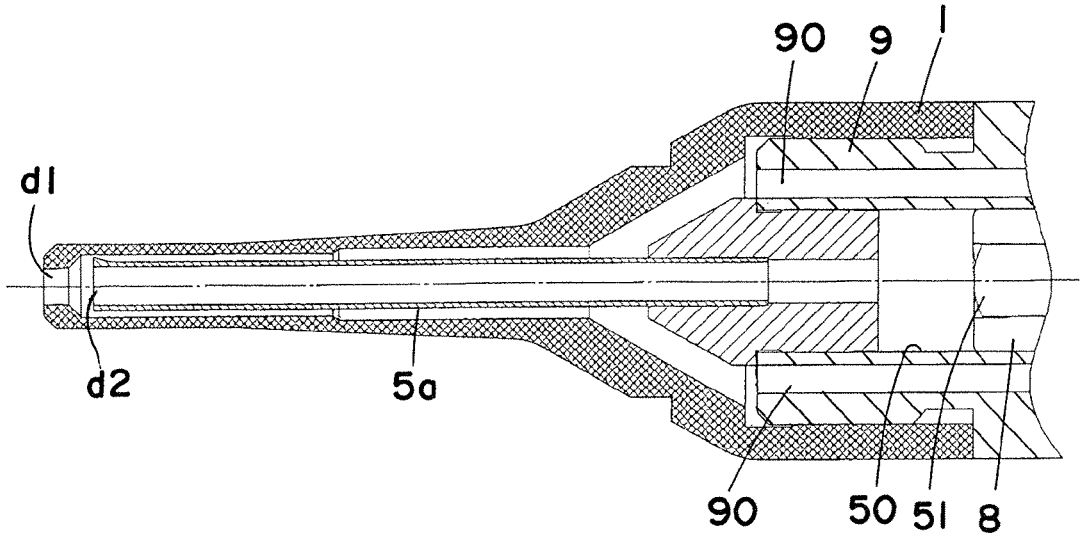
FIG. 26 is a vertical cross-sectional view of a tip portion of a discharge cylinder of the same embodiment as the above.

Specifically explaining with reference to the drawings, as shown in FIGS. 24 and 25, the base side of the discharge cylinder 1 in a barrel shape that is equipped with the nozzle 10 on the tip side is fit and inserted into an inner circumferential side of a shank barrel unit a' in a cylindrical shape that is shaped in a continuously integrated manner on the upper side of the holding unit 3 of which inside is equipped with the introduction pipe 30 for the sealer S (liquid material), and is supported by the holding unit 3 in an integrated manner; the valve mechanism 2 is integrated into the discharge cylinder 1; the valve mechanism 2 is configured such that by gripping together the holding unit 3 and the grip member 4 that is axially supported on the forward side of the holding unit 3, the operating rod 61 that is interlocked via the interlock mechanism 6 including the link rod 67 and the joint spindle 68, and the valve shank 8 that is coupled to the operating rod 61 in an integrated manner, are pushed forward while compressing the spring b, so that valve opening operation is performed so as to open the valve openings 85, and by releasing a grip on the grip member 4, the operating rod 61 and the valve shank 8 are pushed back rearward with a resilient force of the spring b, so that valve closing operation is performed by closing the valve openings 85, accordingly, upon gripping the grip member 4, the valve mechanism 2 performs valve opening operation, so that the sealer S of a liquid material guided through the introduction pipe 30 inside the holding unit 3 flows from the communication aperture 80, via the valve opening 85 that is opened→the empty room 84→the valve opening 85→the flow path 90, into the nozzle 10 of the tip of the discharge cylinder 1, thereby discharging from the bore d1 of the tip aperture; and upon releasing a grip on the grip member 4, the operating rod 61 and the valve shank 8 are pushed back rearward with a resilient force of the spring b that has been compressed, so that the valve mechanism 2 performs valve closing operation so as to close the valve opening 85, thereby stopping a discharge of the sealer from the bore d1 of the tip aperture of the nozzle 10 of the tip of the discharge cylinder 1.

The pump P including the piston 51 and the cylinder 50 integrated in the discharge cylinder 1 is equipped with the piston 51 by being assembled in an integrated manner onto the forward end side of the valve shank 8 of the valve mechanism 2 described above, and is equipped on the forward end side of the discharge cylinder 1 with the cylinder 50 by forming the flow paths 90 inside a cylinder wall material, and forming a cylinder from the inner circumferential surface of the flow-path holding member 9 of which inner circumferential surface is shaped in an integrated manner to be a sleeve for guiding the valve shank 8, so that the pump P that performs pump operation by reciprocating the piston 51 together with operation of pivoting or moving of the grip member 4 by gripping and releasing the grip member 4 is integrated in the discharge cylinder 1, and furthermore, the suction-discharge pipe 5*a* that forms the bore d2 of the suction-discharge aperture of the pump P at the tip aperture is deeply plunged into the inside of the nozzle 10, and the bore d2 of the suction-discharge aperture of its tip is positioned directly in front of the bore d1 of the tip aperture of the nozzle 10.

However, the nozzle 10 of the tip of the discharge cylinder 1 is provided on its tip portion with a head in a shuttering board shape that blocks an open aperture at the tip; the tip aperture 10*a* that has the bore d1 smaller than the inner diameter of the nozzle 10 is opened and provided to the head; and also is opened and provided such that the bore d1 of the tip aperture 10*a* opened and provided satisfies relation of d1≤d2, with respect to the bore d2 of the suction-discharge aperture of the tip aperture of the suction-discharge pipe 5*a* of the pump P positioned inside the nozzle 10.

Figure 27:
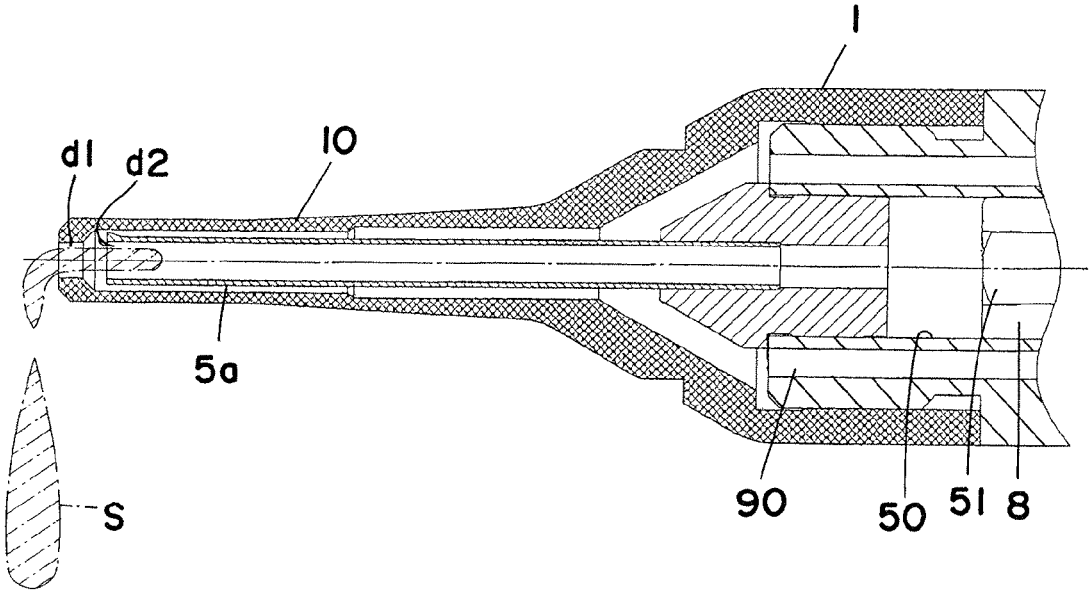
FIG. 27 is an explanatory view of action of the same embodiment as the above.

Accordingly, when by releasing a grip on the grip member 4 and operating the valve mechanism 2 to close with a resilient force of the spring b, a discharge of the sealer S is stopped, the piston 51 of the pump P moves backward with a resilient force of the spring b in a synchronized manner with this, and performs suction operation to the pump P, so that a strong negative internal pressure is generated in a region close to the bore d1 of the tip aperture in the internal space of the nozzle 10, then caused by the internal pressure, as depicted by a dot and dash line in FIG. 25, a base of a drip hanging in an icicle shape from the tip portion of the nozzle 10 when a discharge of the sealer S is stopped is strongly sucked into the nozzle 10 as shown in FIG. 27, and the drip is cut off at its base so as to separate the drip from the nozzle 10 and to let it fall.

Seventh Embodiment

Figure 28:
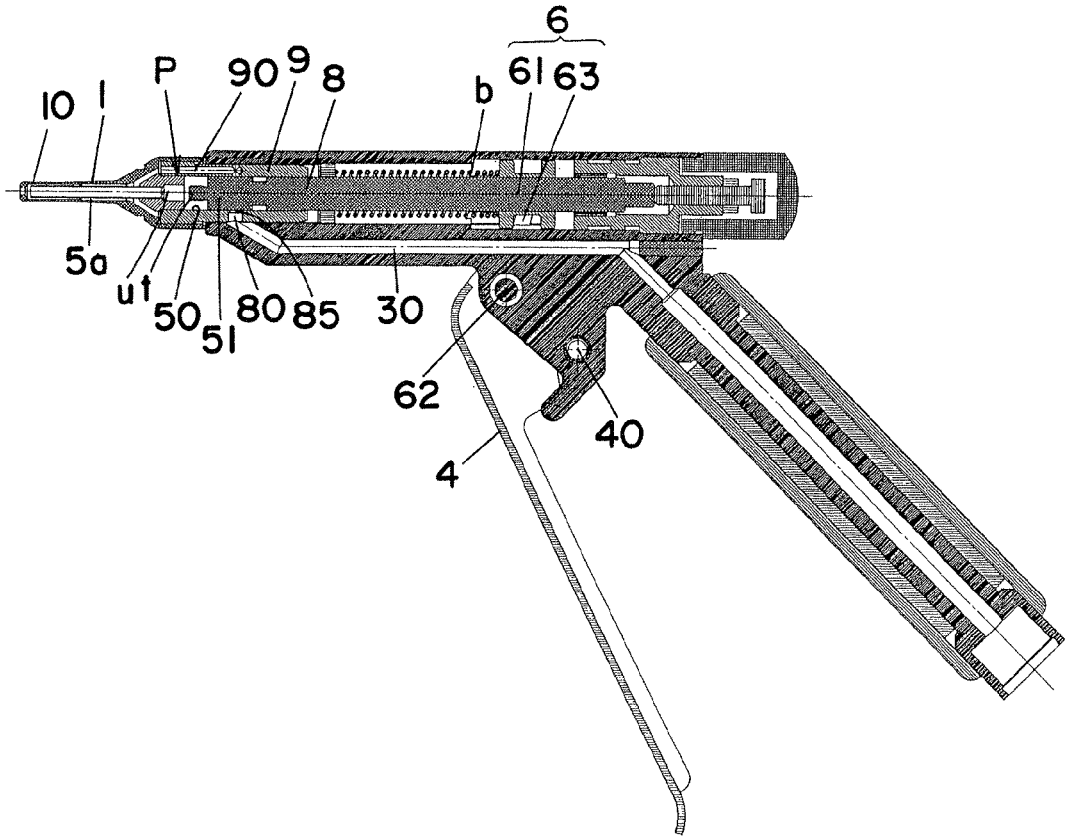
FIG. 28 is a vertical cross-sectional side view of still another embodiment according to the present invention when it is in a state that a piston of a pump is pulled.
Figure 29:
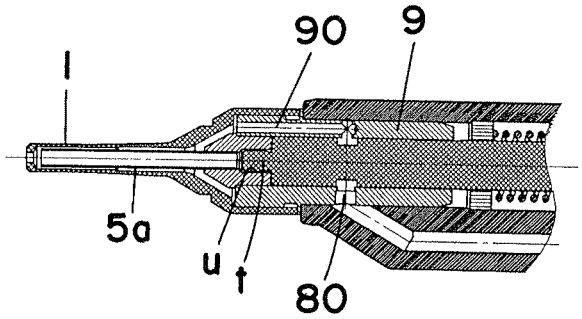
FIG. 29 is a vertical cross-sectional side view of a relevant region of the same embodiment as the above when it is in a state that the piston of the pump is pushed.
Figure 30:
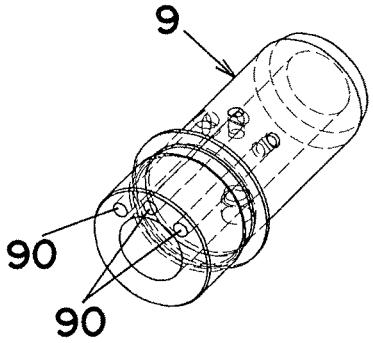
FIG. 30 is a perspective view of a flow-path holding member according to the same embodiment as the above.

FIGS. 28 to 30 depict still another embodiment. The embodiment is a modification of the fifth embodiment shown in FIGS. 15 to 23 described above, and its configuration aspects are basically not different from those according to the above described embodiment, therefore the same component members are assigned with the same reference numerals, and detailed explanations of configurations are omitted.

In contrast to the embodiment described above, this embodiment is an example configured such that as a configuration of the valve mechanism 2 is made simple, leakage of a sealer (a coating agent of a liquid material) via the valve mechanism 2 when closing the valve by releasing a grip on the grip member 4 is reduced; and when the piston 51 of the pump P performs moving in-and-out operation with respect to the cylinder 50, and the volume of the internal space of the cylinder 50 is expanded and contracted, a volume difference is increased, so that a suction quantity of a sealer when the valve is closed is increased.

According to the embodiment, where a projection t in an axial shape is provided in the center region of the end surface of the forward end side of the piston 51 formed and provided on the forward end of the valve shank 8 configured to be fit and inserted into the cylinder 50 that is formed of the inner wall surface of the flow-path holding member 9, and an empty room u in an axial hole shape into which the projection t is to be fit and inserted tightly is formed and provided on the base side of the suction-discharge pipe 5*a*; when the piston 51 is pushed into the cylinder 50, the projection t tightly fills up to the empty room u on the base side of the suction-discharge pipe 5*a*; and when the cylinder 50 is pulled while the valve is closed, the internal volume of the cylinder 50 is expanded up to the empty room u in an axial hole shape; accordingly, a suction effect on a sealer is improved.

Moreover, the flow paths 90 formed and provided inside the flow-path holding member 9 are provided only on the upper circumferential side of the flow-path holding member 9 as shown in FIG. 30, accordingly, a distance between the communication aperture 80 opened and provided on the bottom side of the discharge cylinder 1 and the flow paths 90 is made long, so that it is configured to prevent securely leakage of a sealer from the flow paths 90 that are closed and close to the outer circumferential surface of the valve shank 8, when the valve mechanism 2 is closed.

EXPLANATIONS OF LETTERS OR NUMERALS

A sealer gun
O communication aperture
P pump
S sealer
a main body
a' shank barrel unit
b resilient spring
d1 bore of tip aperture
d2 bore of suction-discharge aperture
k opening
t projection
u empty room
cv check valve
sv stop valve
1 discharge cylinder
10 nozzle
10*a* tip aperture
100 nozzle mounting unit
11 sandwiching plate
12 elastic material
2 valve mechanism
3 holding unit
30 introduction pipe
4 grip member
40 spindle
41 stopper
5*a* suction-discharge pipe
50 cylinder
51 piston
52 mounting member
53 connecting pipe
530 discharge pipe
6 interlock mechanism
60 guide cylinder
61 operating rod
62 joint spindle
63 interlock rod
64 first link rod
65 interlock spindle
66 second link rod
67 link rod
68 joint spindle
69 spring strike plate
7 pressure regulator
70 spring strike plate
8 valve shank
80 communication aperture
81 transparent hole
82 valve seat
83 communication hole
84 empty room
85 valve opening
9 flow-path holding member
90 flow path

The invention claimed is:

1. A dripping prevention apparatus in a sealer gun that on a base side of a body in a cylindrical shape of which tip side is equipped with a discharge cylinder configured to discharge a liquid material, a holding unit is provided, and a grip member capable to be gripped together with the holding unit is axially supported so as to pivot to a position along the holding unit by gripping and to pivot to a position separate from the holding unit with a resilient spring by releasing a grip, an inside of the body accommodates therein a valve mechanism configured to control disconnection and establishment of communication between an introduction pipe side and a tip side of the discharge cylinder, and operation of opening valve and closing valve of the valve mechanism is interlocked to pivoting motion of the grip member so as to open a valve resulting from pivoting of the grip member by gripping, and to stop a discharge of a liquid material from a tip aperture of a nozzle of a tip of the discharge cylinder by closing the valve resulting from resilient pivoting of the grip member by releasing a grip, wherein a pump that includes a cylinder and a piston fitting in the cylinder in a manner capable to move in and out freely is assembled onto the body, an operation rod interlocked with the piston of the pump and the grip member are interlocked via an interlock mechanism so as to perform pump operation of suction and discharge by moving in and out the piston caused by resilient pivoting of the grip member, and a suction-discharge aperture of the pump is positioned in an internal space of the nozzle on the tip side of the discharge cylinder, and when a discharge of a liquid material is stopped by releasing the grip member, a negative or positive pressure is to be introduced into an inside of the nozzle caused by pump operation resulting from resilient pivoting of the grip member.

2. A dripping prevention apparatus in a sealer gun that on a base side of a body in a cylindrical shape of which tip side is equipped with a discharge cylinder configured to discharge a liquid material, a holding unit is provided, and a grip member capable to be gripped together with the holding unit is axially supported so as to pivot to a position along the holding unit by gripping and to pivot to a position separate from the holding unit with a resilient spring by releasing a grip, an inside of the body accommodates therein a valve mechanism configured to control disconnection and establishment of communication between an introduction pipe side and a tip side of the discharge cylinder, and operation of opening valve and closing valve of the valve mechanism is interlocked to pivoting motion of the grip member so as to open a valve resulting from pivoting of the grip member by gripping, and to close the valve resulting from resilient pivoting of the grip member by releasing a grip, wherein a pump that includes a cylinder and a piston fitting in the cylinder in a manner capable to move in and out freely is assembled onto the body, the pump is interlocked to the grip member via an interlock mechanism so as to perform discharge operation by pushing the piston caused by pivoting when gripping the grip member, and to perform suction operation by pulling the piston caused by resilient pivoting of the grip member when releasing a grip on the grip member, and a suction-discharge aperture of the pump is positioned in an internal space of the nozzle on the tip side of the discharge cylinder, and when a discharge of a liquid material from a tip aperture of the nozzle is stopped by releasing a grip on the grip member, a negative pressure is to be introduced into the nozzle caused by suction operation by the pump resulting from resilient pivoting of the grip member.

3. A dripping prevention apparatus in a sealer gun that on a base side of a body in a cylindrical shape of which tip side is equipped with a discharge cylinder configured to discharge a liquid material, a holding unit is provided, and a grip member capable to be gripped together with the holding unit is axially supported so as to pivot to a position along the holding unit by gripping and to pivot to a position separate from the holding unit with a resilient spring by releasing a grip, an inside of the body accommodates therein a valve mechanism configured to control disconnection and establishment of communication between an introduction pipe side and a tip side of the discharge cylinder, and operation of opening valve and closing valve of the valve mechanism is interlocked to pivoting motion of the grip member so as to open a valve resulting from pivoting of the grip member by gripping, and to close the valve resulting from resilient pivoting of the grip member by releasing a grip, wherein a pump that includes a cylinder and a piston fitting in the cylinder in a manner capable to move in and out freely is assembled onto the body, the pump is interlocked to the grip member via an interlock mechanism so as to perform suction operation by pulling the piston caused by pivoting when gripping the grim member, and to perform discharge operation by pushing the piston caused by resilient pivoting of the grip member when releasing a grip on the grip member, and a suction-discharge aperture of the pump is positioned in an internal space of the nozzle on the tip side of the discharge cylinder, and when a discharge of a liquid material is stopped by releasing a grip on the grip member, a positive pressure is to be introduced into the nozzle caused by discharge operation by the pump resulting from resilient pivoting of the grip member.

4. The dripping prevention apparatus in the sealer gun according to claim 1, wherein the pump that includes the cylinder provided on the body and the piston fitting in the cylinder in a manner capable to move in and out freely is supported and assembled onto the body by arranging an axial line in parallel to the discharge cylinder on an underside of an outer circumference of the body, the piston of the pump is interlocked to the grip member via an interlock mechanism arranged on an underside of the discharge cylinder, and the suction-discharge aperture of the pump is positioned in the internal space of the nozzle on the tip side of the discharge cylinder.

5. The dripping prevention apparatus in the sealer gun according to claim 1, wherein the pump that includes the cylinder provided on the body and the piston fitting in the cylinder in a manner capable to move in and out freely is supported and assembled onto the discharge cylinder by arranging an axial in parallel to the discharge cylinder on an upper side of an outer circumference of the body, the piston of the pump is interlocked to the grip member via an interlock mechanism arranged on an upper side of the discharge cylinder, and the suction-discharge aperture of the pump is positioned in the internal space of the nozzle on the tip side of the discharge cylinder.

6. The dripping prevention apparatus in the sealer gun according to claim 1, wherein a tip side of a connecting pipe that connects the suction-discharge aperture of the pump to the internal space of the nozzle on the tip side of the discharge cylinder is formed in a pipe shape, and is coaxially fit and inserted into the nozzle, and a tip aperture is communicated into the nozzle.

7. The dripping prevention apparatus in the sealer gun according to claim 1, wherein a pressure regulator is assembled onto the tip side of the discharge cylinder, the pressure regulator is connected to a pipe line of a connecting pipe connected to the suction-discharge aperture of the pump, and the connecting pipe is communicated to the internal space of the nozzle of the tip of the discharge cylinder.

8. The dripping prevention apparatus in the sealer gun according to claim 1, wherein the pump that includes the cylinder provided on the body and the piston fitting in the cylinder in a manner capable to move in and out freely is coaxially arranged inside the discharge cylinder, an outer circumferential side of the cylinder of the pump is fixed onto an inner circumferential side of the discharge cylinder and assembled to inside the discharge cylinder, and the suction-discharge aperture of the pump is opened to the internal space of the nozzle.

9. The dripping prevention apparatus in the sealer gun according to claim 1, wherein onto the operation rod interlocked with the piston of the pump that includes the cylinder provided on the body and the piston fitting in the cylinder in a manner capable to move in and out freely, a spring configured to give force so as to operate the piston in a direction of pushing in is assembled so as to be compressed by operation of the operation rod to move in a direction of pulling out by gripping the grip member via the interlock mechanism, and when releasing a grip on the grip member, the grip member is configured to pivot resiliently or to move resiliently caused by a spring pressure of the spring.

10. The dripping prevention apparatus in the sealer gun according to claim 1, wherein onto the operation rod interlocked with the piston of the pump that includes the cylinder provided on the body and the piston fitting in the cylinder in a manner capable to move in and out freely, a spring configured to give force so as to operate the piston in a direction of pulling out is assembled so as to be compressed by operation of the operation rod to move in a direction of pushing in by gripping the grip member via the interlock mechanism, and when releasing a grip on the grip member, the grip member is configured to pivot resiliently or to move resiliently caused by a spring pressure of the spring that is compressed.

11. The dripping prevention apparatus in the sealer gun according to claim 1, wherein the pump that includes the cylinder provided on the body and the piston fitting in the cylinder in a manner capable to move in and out freely is coaxially arranged inside the discharge cylinder, a flow path for a liquid material is formed between the cylinder of the pump and an inner circumferential surface of the discharge cylinder, and assembled to inside the body, the suction-discharge aperture of the pump is opened to a space inside the nozzle, the operation rod interlocked with the piston is interlocked to the grip member via the interlock mechanism arranged and provided on an outer circumferential side of the discharge cylinder so as to cause the piston to perform operation of suction and discharge by pivoting by gripping the grip member and by resilient pivoting, a valve mechanism configured to disconnect and to establish communication between the flow path of a liquid material and an introduction pipe by motion of moving into and out from the cylinder is built in the piston, and the valve mechanism controls disconnection and establishment of communication between the introduction pipe and the tip side of the discharge cylinder.

12. The dripping prevention apparatus in the sealer gun according to claim 1, wherein an aperture diameter d1 of a tip aperture formed on a tip of the nozzle on the tip side of the discharge cylinder is formed and provided as an aperture diameter smaller than an inner diameter of the nozzle, and the aperture diameter d1 of the tip aperture of the nozzle is formed and provided so as to establish relation $d1 \leq d2$ between the aperture diameter d1 of the tip aperture and an aperture diameter d2 of the suction-discharge aperture of the pump that is opened to the internal space of the nozzle.

* * * * *